US012331256B2

(12) United States Patent
Yang et al.

(10) Patent No.: US 12,331,256 B2
(45) **Date of Patent: *Jun. 17, 2025**

(54) PROCESS AND SYSTEM FOR PROCESSING AROMATICS-RICH FRACTION OIL

(71) Applicants: CHINA PETROLEUM & CHEMICAL CORPORATION, Beijing (CN); RESEARCH INSTITUTE OF PETROLEUM PROCESSING, SINOPEC, Beijing (CN)

(72) Inventors: Qinghe Yang, Beijing (CN); Yanzi Jia, Beijing (CN); Dawei Hu, Beijing (CN); Chuanfeng Niu, Beijing (CN); Shuling Sun, Beijing (CN); Lishun Dai, Beijing (CN); Zhen Wang, Beijing (CN); Anpeng Hu, Beijing (CN); Liang Ren, Beijing (CN); Dadong Li, Beijing (CN)

(73) Assignees: CHINA PETROLEUM & CHEMICAL CORPORATION, Beijing (CN); RESEARCH INSTITUTE OF PETROLEUM PROCESSING, SINOPEC, Beijing (CN)

( * ) Notice: Subject to any disclaimer, the term of this patent is extended or adjusted under 35 U.S.C. 154(b) by 331 days.

This patent is subject to a terminal disclaimer.

(21) Appl. No.: 17/772,317

(22) PCT Filed: Oct. 30, 2020

(86) PCT No.: PCT/CN2020/125068

§ 371 (c)(1),
(2) Date: Apr. 27, 2022

(87) PCT Pub. No.: WO2021/083302

PCT Pub. Date: May 6, 2021

(65) Prior Publication Data

US 2022/0403263 A1 Dec. 22, 2022

(30) Foreign Application Priority Data

Oct. 31, 2019 (CN) ..... 201911053864.9
Oct. 31, 2019 (CN) ..... 201911054674.9

(51) Int. Cl.
*C10G 67/04* (2006.01)
*C10G 69/00* (2006.01)
(Continued)

(52) U.S. Cl.
CPC ..... *C10G 67/0454* (2013.01); *C10G 69/00* (2013.01); *C10G 69/04* (2013.01);
(Continued)

(58) Field of Classification Search
CPC ..... C10G 67/02; C10G 67/0454; C10G 69/00–06
See application file for complete search history.

(56) References Cited

U.S. PATENT DOCUMENTS 4,213,846 A 7/1980 Becraft et al.
2013/0075303 A1 3/2013 Heraud et al.
(Continued)

FOREIGN PATENT DOCUMENTS

CN 1654603 A 8/2005
CN 1766059 A 5/2006
(Continued)

OTHER PUBLICATIONS

Written Opinion issued on Mar. 17, 2023, by the Intellectual Property Office of Singapore in Singaporean Application No. 11202204573U.
(Continued)

*Primary Examiner* — Renee Robinson
(74) *Attorney, Agent, or Firm* — Panitch Schwarze Belisario & Nadel LLP

(57) ABSTRACT

Described are a process and a system for processing aromatics-rich fraction oil. The process includes: (1) introduc-
(Continued)

ing an aromatics-rich fraction oil into a fifth reaction unit for hydrosaturation, followed by fractionation, to provide a first light component and a first heavy component; (2) introducing a deoiled asphalt and an aromatics-comprising stream including the first heavy component into a hydrogen dissolving unit to be mixed with hydrogen, and introducing the mixed material into a first reaction unit for a hydrogenation reaction; (3) fractionating a liquid-phase product from the first reaction unit to provide a second light component and a second heavy component; (41) introducing the second light component into a second reaction unit for reaction; and (42) introducing the second heavy component into a delayed coking unit for reaction; or using the second heavy component as a component of low sulfur ship fuel oil.

20 Claims, 1 Drawing Sheet

(51) Int. Cl.
*C10G 69/04* (2006.01)
*C10G 69/06* (2006.01)

(52) U.S. Cl.
CPC ..... *C10G 69/06* (2013.01); *C10G 2300/70* (2013.01); *C10G 2400/02* (2013.01); *C10G 2400/04* (2013.01); *C10G 2400/08* (2013.01); *C10G 2400/30* (2013.01)

(56) References Cited

U.S. PATENT DOCUMENTS

| | | | | |
|---|---|---|---|---|
| 2016/0053189 | A1 | 2/2016 | Wang et al. | |
| 2017/0009154 | A1 | 1/2017 | Oprins et al. | |
| 2017/0015916 | A1 | 1/2017 | Oprins et al. | |
| 2017/0022433 | A1* | 1/2017 | Brown | C10G 67/049 |
| 2018/0230389 | A1* | 8/2018 | Moore | C10G 45/08 |

FOREIGN PATENT DOCUMENTS

| | | | |
|---|---|---|---|
| CN | 100340643 | C | 10/2007 |
| CN | 101045884 | A | 10/2007 |
| CN | 102453541 | A | 5/2012 |
| CN | 104093818 | A | 10/2014 |
| CN | 104232158 | A | 12/2014 |
| CN | 103102944 | B | 4/2015 |
| CN | 103805240 | B | 11/2015 |
| CN | 105567316 | A | 5/2016 |
| CN | 105623725 | A | 6/2016 |
| JP | 2017511828 | A | 4/2017 |
| JP | 2019104920 | A | 6/2019 |
| KR | 10-2016-0110711 | A | 9/2016 |
| RU | 2570200 | C2 | 12/2015 |

OTHER PUBLICATIONS

International Search Report (PCT/ISA/210) with an English translation and Written Opinion (PCT/ISA/237) mailed on Jan. 27, 2021, by the China National Intellectual Property Administration as the International Searching Authority for International Application No. PCT/CN2020/125068. (13 pages).

Office Action issued on Oct. 15, 2024, by the Japanese Patent Office in corresponding Japanese Application No. 2022-525049, and English translation of the Office Action (9 pages).

* cited by examiner

PROCESS AND SYSTEM FOR PROCESSING AROMATICS-RICH FRACTION OIL

TECHNICAL FIELD

The invention relates to the field of processing hydrocarbon oil, in particular to a process and a system for processing aromatics-rich fraction oil.

BACKGROUND

Highly effective conversion of residual oil is the core of oil refining enterprises. The residual oil hydrogenation on fixed bed is a key technology for the highly effective conversion of residual oil, and has the characteristics of good product quality, mature process and the like.

However, the high content of asphaltene and metals in the residual oil is a limiting factor of the operation period of the residual oil hydrogenation on fixed bed.

In order to solve the problem, a solvent deasphalting (demetalization), hydrotreating-catalytic cracking combined process technology (SHF) for residual oil developed by SINOPEC Research Institute of Petroleum Processing (RIPP) is an innovative technology for producing clean fuels for vehicles from low-value vacuum residual oil to the maximum extent and prolonging the running period. However, because of high softening point of the deoiled asphaltene (DOA), the transportation and the utilization are difficult, and the popularization of the SHF technology is limited.

The new combined process for producing products rich in propylene by hydrogenation-deep catalytic cracking (DCC) of residual oil is also limited by the influence of asphaltene and metals in the residual oil. The hydrogen content of the hydrogenated residual oil is low, the operation period of the residual oil hydrogenation is short, the yield of propylene from DCC is low, and the economic benefit of the combination technology is limited.

In addition, in 2020, a new low-sulfur ship fuel standard with a sulfur fraction $\ngtr$ 0.5% by weight and a low-sulfur petroleum coke standard with a sulfur fraction $\ngtr$ 3.0% by weight are to be implemented. A technology for producing the low-sulfur ship fuel (low-sulfur petroleum coke) at low cost is also a problem which needs to be solved urgently at present.

Therefore, the conversion of DOA to material for low sulfur ship fuel or for low sulfur petroleum coke production is a technical challenge that needs to be addressed.

SUMMARY OF THE INVENTION

The purpose of the invention is to provide a novel process for processing aromatics-rich fraction oils, which enables better hydrotreating results and long-term stable operation of the apparatus, even at lower hydrogen partial pressures, lower hydrogen-to-oil ratios and higher space velocities.

In order to achieve the above purpose, a first aspect of the present invention provides a process for processing an aromatics-rich fraction oil, the process comprising:

(1) introducing an aromatics-rich fraction oil into a fifth reaction unit for hydrosaturation, followed by fractionation, to provide a first light component and a first heavy component, wherein the first light component and the first heavy component has a cutting point of 100-250° C., and the aromatic content in the first heavy component is more than or equal to 20 wt %;

(2) introducing a deoiled asphalt and an aromatics-comprising stream comprising the first heavy component into a hydrogen dissolving unit to be mixed with hydrogen, and introducing the mixed material into a first reaction unit for a hydrogenation reaction, wherein the first reaction unit comprises a mineral-rich precursor material and/or a hydrogenation catalyst, the first reaction unit is a liquid-phase hydrogenation reaction unit, the mineral-rich precursor material is a material capable of adsorbing at least one metal selected from V, Ni, Fe, Ca and Mg, and the deoiled asphalt and the aromatics-containing stream are used in such an amount ratio that a mixed feedstock formed by the deoiled asphalt and the aromatics-containing stream is in liquid state at a temperature of not higher than 400° C.;

(3) fractionating a liquid-phase product from the first reaction unit to provide a second light component and a second heavy component, wherein the cutting point for the second light component and the second heavy component is at 240-450° C.;

(41) introducing the second light component into a second reaction unit for reaction, to provide at least one product selected from a gasoline component, a diesel component and a BTX feedstock component, wherein the second reaction unit is at least one selected from the group consisting of a hydrocracking unit, a catalytic cracking unit and a diesel hydro-upgrading unit; and

(42) introducing the second heavy component into a delayed coking unit for reaction, to provide at least one product selected from the group consisting of coker gasoline, coker diesel, coker wax oil and low sulfur petroleum coke; or using the second heavy component as a component of low sulfur ship fuel oil.

A second aspect of the invention provides a system for processing an aromatics-rich fraction oil, the system comprising:

A third reaction unit, for hydrosaturation and fractionation on the aromatics-rich fraction oil to provide a first light component and a first heavy component;

A hydrogen dissolving unit in fluid communication with the third reaction unit, for mixing therein the deoiled asphalt and the aromatics-containing stream comprising the first heavy component from the third reaction unit with hydrogen;

A first reaction unit in fluid communication with the hydrogen dissolving unit, which is a liquid-phase hydrogenation reaction unit, and is used for carrying out hydrogenation reaction therein of the mixed material from the hydrogen dissolving unit;

A separation unit in fluid communication with the first reaction unit, for fractionating the liquid phase product from the first reaction unit therein;

A second reaction unit in fluid communication with the separation unit, for reacting therein of the second light component obtained in the separation unit, wherein the second reaction unit being at least one selected from the group consisting of a hydrocracking unit, a catalytic cracking unit, and a diesel hydro-upgrading unit;

A delayed coking unit in fluid communication with the separation unit, for reacting therein of the second heavy component obtained from the separation unit, to provide at least one product selected from the group consisting of coker gasoline, coker diesel, coker wax oil, and low sulfur petroleum coke;

An outlet in fluid communication with the separation unit, for discharging the second heavy component obtained from the separation unit as a low sulfur ship fuel oil fraction from the system.

When the process for processing the aromatics-rich fraction oil according to the present invention is used for treating a residual oil, a relatively better hydrotreating effect and a long period of stable operation of the device can be obtained, even if the process is carried out at a lower hydrogen partial pressure, a lower hydrogen-oil ratio and at a higher space velocity.

The invention is especially suitable for the hydro-conversion of atmospheric residue and vacuum residue, in particular for the hydro-conversion of poor residual oil having high contents of metals, high contents of carbon residue, high contents of fused ring substances and high nitrogen content.

The invention provides a process for hydrotreating deoiled asphalt (DOA), which enables heavy oil to be efficiently converted and can produce gasoline and BTX raw materials, and a system and a process for flexibly producing low-sulfur ship fuel and low-sulfur petroleum coke.

DESCRIPTION OF THE REFERENCE SIGNS

Figure 1:
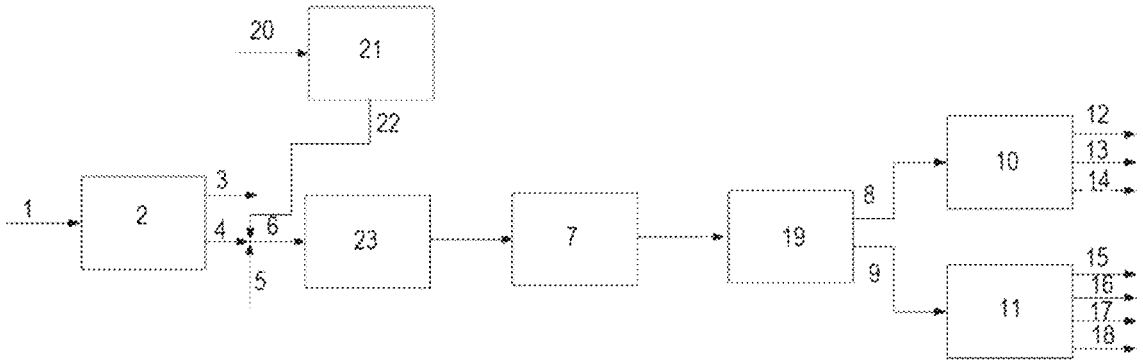
FIG. 1 is a flow chart for processing an aromatics-rich fraction oil in accordance with a preferred embodiment of the present invention.

| | | | |
|---|---|---|---|
| 1 | Heavy oil feedstock | 2 | Solvent deasphalting unit |
| 3 | Deasphalted oil | 4 | Deoiled asphalt |
| 5 | Aromatic compound | 6 | Mixed feedstock |
| 7 | First reaction unit | 8 | Second light component |
| 9 | Second heavy component | 10 | Second reaction Unit |
| 11 | Delayed coking unit | 12 | BTX feedstock component |
| 13 | Gasoline component | 14 | Diesel component |
| 15 | Coker gasoline | 16 | Coker diesel |
| 17 | Coker waxy oil | 18 | Low sulfur petroleum coke |
| 19 | Separation unit | 20 | Aromatics-rich fraction oil |
| 21 | Third reaction unit | 22 | First heavy component |
| 23 | Hydrogen dissolving unit | 24 | Fourth reaction unit |
| 25 | DCC unit | 26 | Propylene |
| 27 | LCO | 28 | HCO |
| 29 | Slurry oil | | |

Embodiments

The endpoints and any values of the ranges disclosed herein are not limited to the precise range or value, while these ranges or values should be understood to encompass values close to these ranges or values. For numerical ranges, each range between its endpoints and individual point values, and each individual point value can be combined with each other to give one or more new numerical ranges, and such new numerical ranges should be construed as specifically disclosed herein.

As stated above, a first aspect of the present invention provides a process for processing an aromatics-rich fraction oil, comprising:

(1) introducing an aromatics-rich fraction oil into a fifth reaction unit for hydrosaturation, followed by fractionation, to provide a first light component and a first heavy component, wherein the first light component and the first heavy component has a cutting point of 100-250° C., and the aromatic content in the first heavy component is more than or equal to 20 wt %;

(2) introducing a deoiled asphalt and an aromatics-comprising stream comprising the first heavy component into a hydrogen dissolving unit to be mixed with hydrogen, and introducing the mixed material into a first reaction unit for a hydrogenation reaction, wherein the first reaction unit comprises a mineral-rich precursor material and/or a hydrogenation catalyst, the first reaction unit is a liquid-phase hydrogenation reaction unit, the mineral-rich precursor material is a material capable of adsorbing at least one metal selected from V, Ni, Fe, Ca and Mg, and the deoiled asphalt and the aromatics-containing stream are used in such an amount ratio that a mixed feedstock formed by the deoiled asphalt and the aromatics-containing stream is in liquid state at a temperature of not higher than 400° C.;

(3) fractionating a liquid-phase product from the first reaction unit to provide a second light component and a second heavy component, wherein the cutting point for the second light component and the second heavy component is at 240-450° C.;

(41) introducing the second light component into a second reaction unit for reaction, to provide at least one product selected from a gasoline component, a diesel component and a BTX feedstock component, wherein the second reaction unit is at least one selected from the group consisting of a hydrocracking unit, a catalytic cracking unit and a diesel hydro-upgrading unit; and

(42) introducing the second heavy component into a delayed coking unit for reaction, to provide at least one product selected from the group consisting of coker gasoline, coker diesel, coker wax oil and low sulfur petroleum coke; or using the second heavy component as a component of low sulfur ship fuel oil.

Preferably, the deoiled asphalt and the aromatics-containing stream are used in such an amount ratio that a mixed feedstock formed from the deoiled asphalt and the aromatics-containing stream is in a liquid state at a temperature of not higher than 280° C. It is further preferred that the deoiled asphalt and the aromatics-containing stream are used in such a ratio that the mixed feedstock formed from the deoiled asphalt and the aromatics-containing stream is in a liquid state at a temperature of not higher than 100° C.

Preferably, the hydrosaturation reaction carried out in the third reaction unit is a partial hydrosaturation, and particularly preferably that the first light component and the first heavy component has a the cutting point of 180° C.

Preferably, the hydrogen-dissolving unit of the invention is operated under conditions of: a volume ratio of the feeding amount of hydrogen to the mixed feedstock formed by the deoiled asphalt and the aromatics-containing stream (namely, the volume ratio of hydrogen-to-oil) of 30-200, more preferably 50-150, an operation temperature of 300-450° C., and a pressure of 2-20 MPa.

According to the process of the invention, the mixed material obtained after mixing with hydrogen in the hydrogen dissolving unit can be fed into the first reaction unit in an upward flow mode or in a downward flow mode. Preferably, the mixed material obtained after mixing with hydrogen in the hydrogen dissolving unit is fed into the first reaction unit in an upward flowing mode, so that the hydrogen dissolved and dispersed in the oil is substantially prevented from gathering to form large bubbles and escape during the reaction. Thereby the hydrogenation reaction can be provided with enough hydrogen source, resulting in a better hydrogenation treatment effect, further reducing the coking tendency of the catalyst, keeping the catalyst at a higher catalytic activity, and further prolonging the service life of the catalyst and prolonging the stable operation period of the device.

The first light component is preferably fed into a catalytic cracking unit to produce lower olefins. The specific operation conditions for the first light component fed into the catalytic cracking unit to produce the low carbon olefin are not specifically limited by the present invention.

Particularly preferably, the second light component and the second heavy component have a cutting point of 350° C.

Preferably, in step (2), the deoiled asphalt and the aromatics-containing stream are used in a ratio such that the viscosity at 100° C. of the mixed feedstock formed from the deoiled asphalt and the aromatics-containing stream is not greater than 400 $mm^2/s$, more preferably not greater than 200 $mm^2/s$, further preferably not greater than 100 $mm^2/s$.

In step (2), the aromatics-containing stream further comprises an aromatic hydrocarbon and/or an aromatic oil, and the aromatic oil is at least one selected from the group consisting of LCO, HCO, FGO (catalytic heavy component oil), ethylene tar, coal tar, coker diesel, and coker wax oil.

Preferably, the aromatic hydrocarbon is one or more selected from benzene, toluene, xylene, naphthalene, methylnaphthalene, multi-branched naphthalene and aromatic hydrocarbon with more than two rings, and preferably polycyclic aromatic hydrocarbon with no more than three rings or a mixture thereof. Particularly preferably, the aromatic hydrocarbon is at least one selected from the group consisting of benzene, toluene, xylene, naphthalene, naphthalene substituted with at least one $C_{1-6}$ alkyl group, and tricyclic or higher aromatic hydrocarbons.

More preferably, the aromatic hydrocarbon content in the aromatics-rich fraction oil is more than or equal to 20 wt %, preferably more than or equal to 25 wt %, preferably more than or equal to 40 wt %, and more preferably more than or equal to 60 wt %.

Preferably, in step (2), the deoiled asphalt is obtained by subjecting a heavy oil feedstock to a solvent deasphalting process in a solvent deasphalting unit.

Preferably, in the solvent deasphalting unit, the yield of the deoiled asphalt is not more than 50% by weight, more preferably not more than 40% by weight, and still more preferably not more than 30% by weight.

According to a preferred embodiment, in step (2), the aromatics-containing stream is an aromatics-rich fraction oil, and the weight ratio of the amount of the deoiled asphalt to the amount of the aromatics-containing stream is from 1:10 to 50:10, more preferably 2:10 to 30:10; more preferably 3:10 to 15:10.

Preferably, the process of the present invention further comprises: recycling the coker diesel and/or coker gas oil obtained in step (42) to the first reaction unit in step (1) for hydrosaturation.

Preferably, in the step (1), the third reaction unit is at least one of a fixed bed reactor, a moving bed reactor and a boiling bed reactor.

Preferably, the third reaction unit is operated under conditions of: a reaction temperature of 200-420° C., a reaction pressure of 2-18 MPa, a liquid hourly space velocity of 0.3-10 and a volume ratio of hydrogen to oil of 50-5000. More preferably, the third reaction unit is operated under conditions of: a reaction temperature of 220-400° C., a reaction pressure of 2-15 MPa, a liquid hourly space velocity of 0.3-5 and a volume ratio of hydrogen to oil of 50-4000.

Preferred embodiments for the third reaction unit of this fifth variant are provided below.

The partial hydrosaturation of the aromatics-rich fraction oil in the presence of hydrogen is generally operated under conditions of: the partial hydrosaturation technology for the aromatics-rich fraction oil being a fixed bed/boiled bed/moving bed hydrotreating technology. Taking the currently industrial fixed bed diesel or wax oil hydrogenation technology as an example, the reactor or the reaction bed layer comprises at least a hydrofining catalyst. The hydrofining catalyst used in the partial hydrosaturation of the aromatics-rich fraction oil preferably has good and moderate hydrosaturation activity, to avoid further saturation of a tetralin-like structure to a decahydronaphthalene or cycloalkane structure with lower hydrogen donating ability. For these catalysts, generally a porous refractory inorganic oxide such as alumina or molecular sieve is used as the support, an oxide or sulfide of metal from Group VIB and/or Group VIII such as W, Mo, Co, Ni and the like is used as the active components, and other various auxiliaries such as elements P, Si, F, B and the like are optionally added, such as RS series pretreatment catalysts developed by RIPP. The RS series catalyst is a NiMo catalyst.

The first reaction unit is particularly preferably a residual oil liquid phase hydrogenation reactor.

Preferably, in step (2), the first reaction unit is operated under conditions of: a reaction temperature of 260-500° C., a reaction pressure of 2.0-20.0 MPa, a volume ratio of the recycling oil to the raw oil at inlet of the first reaction unit of 0.1:1-15:1, and a liquid hourly space velocity of 0.1-1.5 $h^{-1}$. The liquid hourly volume space velocity and the reaction pressure are selected according to the nature of the materials to be treated and the desired conversion and refining depth. The mixed feedstock formed by the deoiled asphalt and the aromatics-containing stream can be fed in from the top of the reactor of the first reaction unit after being mixed with hydrogen, passing through the catalyst bed layer from top to bottom; or the catalyst is fed in from the bottom of the reactor of the first reaction unit, passing through the catalyst bed layer from bottom to top.

Preferably, in step (2), the mineral-rich precursor material comprises a support and an active component element loaded on the support, wherein the support is at least one selected from the group consisting of aluminum hydroxide, alumina and silica, and the active component element is at least one metal element selected from the group consisting of Group VIB and Group VIII. More preferably, the active component in the mineral-rich precursor material is an oxide and/or sulphide of a metal element selected from Group VIB and Group VIII.

Preferably, in step (2), the mineral-rich precursor material has a loss on ignition of not less than 3 wt %, a specific surface area of not less than 80 $m^2/g$, and a water absorption of not less than 0.9 g/g. The loss on ignition refers to the percentage of the reduced weight of the mineral-rich precursor material after a roasting treatment at 600° C./2 h compared with the weight before the roasting; and the water absorption refers to the percentage of the increased weight of the mineral-rich precursor material after immersion in water for half an hour at room temperature (for example, 25° C.) compared with the weight before the immersion.

According to a preferred embodiment, in step (2), the first reaction unit is sequentially, following the reactant flow direction, charged with a first mineral-rich precursor material and a second mineral-rich precursor material, wherein the second mineral-rich precursor material has a loss on ignition equal to or greater than that of the first mineral-rich precursor material.

According to the preferred embodiment above, it is further preferred that the first mineral-rich precursor material has a loss on ignition of 3 to 15 wt %, and the second mineral-rich precursor material has a loss on ignition of not less than 15 wt %.

According to the preferred embodiment above, it is further preferred that the first mineral-rich precursor material and the second mineral-rich precursor material are loaded at a ratio by volume of from 5:95 to 95:5.

The hydrogenation catalyst of the present invention may be a graded combination of different catalysts, and preferably the hydrogenation catalyst is at least capable of catalyzing hydrodemetallization and hydrodesulfurization reactions.

According to the present invention, the specific type of catalyst capable of catalyzing the hydrodemetallization reaction, hydrodesulfurization reaction, hydrodeasphalting reaction, and hydrodecarbonization reaction is not particularly limited, and a catalyst capable of catalyzing the above reactions conventionally used in the art may be used.

The hydrogenation catalyst of the invention can, for example, use a porous refractory inorganic oxide as support, an oxide or sulfide of a metal from Group VIB and/or Group VIII as active component, and optionally with the addition of an auxiliary agent.

Preferably, after the first reaction unit of the invention is operated for a long period, the mineral-rich precursor material is converted into a vanadium-rich material, and the vanadium content in the vanadium-rich material is not less than 10% by weight; particularly preferably, the ore-rich precursor material is converted into a vanadium-rich material having a V content of 20 wt % or more, from which high-value $V_2O_5$ can be directly refined.

Preferred embodiments for the first reaction unit of the present invention are provided below.

The technology for hydrotreating a feedstock involved in the first reaction unit of the invention is a liquid-phase hydrotreating technology, the reactor or the reaction bed layer at least comprises a mineral-rich precursor material and/or a hydrogenation catalyst, and the mineral-rich precursor material mainly composed by two parts: a support having strong capability of adsorbing vanadium-containing organic compounds in oil, and an active component having hydrogenation activity function. The support is primarily obtained by extruding, molding and drying silica, aluminum hydroxide or a mixture of aluminum hydroxide/alumina. The surface of the support is rich in-OH. The support has strong adsorption capacity on vanadium-containing organic compounds in oil. The support has a loss on ignition of not less than 5 wt % after roasting at 600° C. for 2 hours. The active component mainly comprises an oxide or sulfide of metals of Group VIB and/or Group VIII such as W, Mo, Co, Ni and the like.

The hydrogenation catalyst involved in the foregoing preferred embodiment is generally a heavy residue hydrogenation catalyst, and the heavy residue hydrogenation catalyst refers to a combined catalyst having functions of heavy residue hydrodemetallization, hydrodesulfurization, hydrodecarbonization, and the like. For these catalysts, generally a porous refractory inorganic oxide such as alumina is used as the support, an oxide or sulfide of metal from Group VIB and/or Group VIII such as W, Mo, Co, Ni and the like is used as the active components, and other various auxiliaries such as elements P, Si, F, B and the like are optionally added, such as RDM, RCS series heavy metals, residual oil hydrodemetallization catalysts and desulfurization catalysts developed by RIPP. At present, in the liquid-phase residual oil hydrogenation technology, a plurality of catalysts are often used together. In the present invention, a mineral-rich precursor material, a hydrodemetallation desulfurization catalyst and a hydrodesulfurization catalyst are preferably used, which are generally loaded in such a sequence that the feedstock is sequentially brought into contact with the mineral-rich precursor material, the hydrodemetallation desulfurization and the hydrodesulfurization catalyst. Of course, there are techniques of loading a mixture of these catalysts.

According to a preferred embodiment, in step (41), the second reaction unit is a hydrocracking unit, operated under conditions of: a reaction temperature of 360-420° C., a reaction pressure of 10.0-18.0 MPa, a volume ratio of hydrogen to oil of 600-2000, and a liquid hourly volume space velocity of 1.0-3.0 $h^{-1}$.

Preferably, the hydrocracking unit is loaded with at least one hydrotreating catalyst and at least one hydrocracking catalyst.

Preferably, the hydrocracking unit is a fixed bed hydrocracking unit.

When the second reaction unit is a hydrocracking unit, preferred embodiments in the second reaction unit of the present invention are provided below.

In the step (41), the second light component is introduced into a second reaction unit for reaction, using fixed bed hydrocracking technology. Taking the conventional technology of hydrocracking wax oil by fixed bed in industry as an example, the reactor or the reaction bed layer comprises at least two hydrocracking catalysts, namely a pretreatment catalyst and a hydrocracking catalyst. As the material obtained from liquid-phase hydrotreatment followed by fractionation has high contents of metal, sulfur and nitrogen and high carbon residue value, the pretreatment catalyst preferably has strong demetallization activity and good desulfurization and denitrification activities, so as to ensure the activity of the subsequent hydrocracking catalyst. The hydrocracking catalyst preferably has good hydrocracking activity and high VGO conversion and HDS activity. For these catalysts, generally a porous refractory inorganic oxide such as alumina or molecular sieve is used as the support, an oxide or sulfide of metal from Group VIB and/or Group VIII such as W, Mo, Co, Ni and the like is used as the active components, and other various auxiliaries such as elements P, Si, F, B and the like are optionally added, such as RS series pretreatment catalysts and RHC series hydrocracking catalysts developed by RIPP. The RS series catalyst is a NiW catalyst, and the RHC series catalyst is a NiMo molecular sieve catalyst.

According to another preferred embodiment, in step (41), the second reaction unit is a catalytic cracking unit, and the catalytic cracking unit is a Fluid Catalytic Cracking (FCC) unit.

According to another preferred embodiment, the technology used for catalytic cracking the second light component Fluid Catalytic Cracking (FCC) technology, preferably LTAG technology developed by RIPP, and mainly produces gasoline fractions and liquefied gas.

Preferably, the fluid catalytic cracking unit is operated under conditions of: a reaction temperature of 500-600° C., a catalyst-to-oil ratio of 3-12, and a retention time of 0.6-6 s.

The catalyst-to-oil ratio of the invention denotes the weight ratio of the catalyst-to-oil, unless otherwise specified.

According to another preferred embodiment, in step (41), the second reaction unit is a diesel hydrogenation upgrading unit, operated under conditions of: a reaction temperature of 330-420° C., a reaction pressure of 5.0-18.0 MPa, a volume ratio of hydrogen to oil of 500-2000, and a liquid hourly volume space velocity of 0.3-3.0 $h^{-1}$.

Preferably, the diesel hydrogenation upgrading unit is loaded with at least one diesel hydrogenation upgrading catalyst.

The diesel hydrogenation upgrading catalyst can be an RS series pretreatment catalyst and an RHC-100 series diesel hydrocracking catalyst developed by RIPP.

According to a preferred embodiment, in step (42), the second heavy component is introduced into a delayed coking unit for reaction, to provide at least one product selected from coker gasoline, coker diesel, coker wax oil and low sulfur petroleum coke, wherein the delayed coking unit is operated under conditions of: a reaction temperature of 440-520° C., and a retention time of 0.1-4 h.

According to another preferred embodiment, in step (42), the sulfur content of the second heavy component is not greater than 1.8 wt %, the second heavy component is introduced into a delayed coking unit for reaction, to provide a low-sulfur petroleum coke. More preferably, the sulfur content of the low-sulfur petroleum coke is not greater than 3 wt %.

Preferably, in step (42), the second heavy component is used as a low-sulfur ship fuel oil component, and the conditions are controlled such that the sulfur content of the low-sulfur ship fuel oil component is not more than 0.5 wt %.

According to the present invention, the specific operation of the solvent deasphalting treatment is not particularly limited, and a conventional solvent deasphalting process can be used. The operating parameters of the solvent deasphalting process are exemplified in Examples of the present invention, which should not be understood by those skilled in the art as limiting the invention.

The process of the present invention is suitable for the hydro-conversion of atmospheric residue and vacuum residue, in particular for the hydro-conversion of poor residual oil having high contents of metals (Ni+V>150 μg/g, especially Ni+V>200 μg/g), high contents of carbon residue (weight fraction of carbon residue >17%, especially weight fraction of carbon residue >20%) and high contents of fused ring substances.

As stated above, a second aspect of the present invention provides a system for processing an aromatics-rich fraction oil, the system comprising:

A third reaction unit, for hydrosaturation and fractionation on the aromatics-rich fraction oil to provide a first light component and a first heavy component;

A hydrogen dissolving unit in fluid communication with the third reaction unit, for mixing therein the deoiled asphalt and the aromatics-containing stream comprising the first heavy component from the third reaction unit with hydrogen;

A first reaction unit in fluid communication with the hydrogen dissolving unit, which is a liquid-phase hydrogenation reaction unit, and is used for carrying out hydrogenation reaction therein of the mixed material from the hydrogen dissolving unit;

A separation unit in fluid communication with the first reaction unit, for fractionating the liquid phase product from the first reaction unit therein;

A second reaction unit in fluid communication with the separation unit, for reacting therein of the second light component obtained in the separation unit, wherein the second reaction unit being at least one selected from the group consisting of a hydrocracking unit, a catalytic cracking unit, and a diesel hydro-upgrading unit;

A delayed coking unit in fluid communication with the separation unit, for reacting therein of the second heavy component obtained from the separation unit, to provide at least one product selected from the group consisting of coker gasoline, coker diesel, coker wax oil, and low sulfur petroleum coke;

An outlet in fluid communication with the separation unit, for discharging the second heavy component obtained from the separation unit as a low sulfur ship fuel oil fraction from the system.

Preferably, the delayed coking unit is in fluid communication with the hydrogen dissolving unit, for recycling the coker gas oil and/or the coker gas oil obtained in the delayed coking unit back to the first reaction unit.

Preferably, the system further comprises a solvent deasphalting unit in fluid communication with the hydrogen dissolving unit, which is used for solvent deasphalting the heavy oil feedstock therein and introducing the deasphalted asphalt obtained after the solvent deasphalting into the hydrogen dissolving unit.

According to a preferred embodiment, in the system of the invention, the second reaction unit is a hydrocracking unit.

According to another preferred embodiment, in the system of the present invention, the second reaction unit is a catalytic cracking unit and the catalytic cracking unit is a fluidized catalytic cracking unit.

According to another preferred embodiment, in the system of the present invention, the second reaction unit is a diesel hydro-upgrading unit.

The invention also provides a first variant of the process, in which the process further comprises:

(11) introducing a heavy raw oil into the solvent deasphalting unit for solvent deasphalting treatment, to provide a deoiled asphalt and a deasphalted oil;

(12) introducing the deasphalted oil into a fourth hydrogenation unit for hydrogenation reaction, and introducing a liquid phase effluent obtained in the fourth hydrogenation unit into a DCC unit for reaction, to provide propylene, LCO, HCO and slurry oil, wherein the fourth hydrogenation unit is a fixed bed hydrogenation unit;

(1) using the aromatics-rich fraction oil comprising LCO and/or HCO from the DCC unit as the aromatics-rich fraction oil in step (1).

In this first variant, preferably, the process of the invention further comprises: recycling the coker diesel and/or coker gas oil obtained in step (42) to the third reaction unit for hydrosaturation.

Preferably, in step (12), the fourth reaction unit is operated under conditions of: a reaction temperature of 280-400° C., a reaction pressure of 6.0-14.0 MPa, a volume ratio of hydrogen to oil of 600-1200, and a liquid hourly space velocity of 0.3-2.0 $h^{-1}$.

Preferably, in step (12), the fourth reaction unit is loaded with at least two hydrogenation catalysts. More preferably, in step (12), the hydrogenation catalyst is a catalyst capable of catalyzing at least one reaction selected from the group consisting of a hydrodemetallization reaction, a hydrodesulfurization reaction, and a hydrodecarbonization reaction. The hydrogenation catalyst is generally supported on a porous refractory inorganic oxide, such as alumina. Particularly preferably, in step (12), the hydrogenation catalyst comprises alumina as a support and a metal element from Group VIB and/or Group VIII as an active component element, and optionally also comprises at least one auxiliary element selected from P, Si, F and B. In the hydrogenation catalyst, the metal elements from Group VIB and Group VIII may be, for example, W, Mo, Co, Ni, or the like. In the hydrogenation catalyst, the active component may be an oxide and/or a sulfide of the above-mentioned active component element.

Preferred embodiments for the fourth reaction unit of the present invention are provided below:

The conditions of the third hydrogenation unit for deasphalted oil (DAO) in the presence of hydrogen are generally as follows: the hydrotreating technology of DAO is fixed bed hydrotreating technology. Taking the currently industrial fixed bed heavy and residual oil hydrogenation technology as an example, the reactor or the reaction bed layer comprises at least two hydrogenation catalysts, and the heavy and residual oil hydrogenation catalyst refers to a combined catalyst with the functions of hydrodemetallization, hydrodesulfurization, hydrodenitrogenation, hydrodecarbonization and the like for both heavy oil and residual oil. For these catalysts, generally a porous refractory inorganic oxide such as alumina is used as the support, an oxide or sulfide of metal from Group VIB and/or Group VIII such as W, Mo, Co, Ni and the like is used as the active components, and other various auxiliaries such as elements P, Si, F, B and the like are optionally added, such as RDM, RCS series heavy metals, residual oil hydrodemetallization catalysts and desulfurization catalysts developed by RIPP. At present, in the fixed bed residual oil hydrogenation technology, a plurality of catalysts are often used together. A hydrodemetallization catalyst, a hydrodesulfurization catalyst and a hydrodenitrogenation catalyst are used, with such a general loading sequence that the raw oil is sequentially contacted with the hydrodemetallization catalyst, the hydrodesulfurization catalyst and the hydrodenitrogenation catalyst, and sometimes one or two catalysts are absent according to the situation. For example, only the hydrodemetallization catalyst and the hydrodesulfurization catalyst are loaded, but the hydrodenitrogenation catalyst is not loaded. Of course, there is a technology of loading these catalysts as a mixture.

The process of processing an aromatics-rich fraction oil according to the invention is described in further detail below with reference to FIGS. 1 and 2.

As shown in FIG. 1, an aromatics-rich fraction oil 20 is fed into a third reaction unit 21 for hydrosaturation, followed by fractionation, to provide a first light component and a first heavy component 22; and a heavy oil feedstock 1 is fed into a solvent deasphalting unit 2 for solvent deasphalting treatment to provide a deoiled asphalt 4 and deasphalted oil 3; the deoiled asphalt 4 and the aromatics-containing stream comprising the first heavy component 22 are mixed to form a mixed feedstock 6, which is mixed with hydrogen in a hydrogen dissolving unit 23, and the mixed material obtained is fed into a first reaction unit 7 for hydrogenation reaction, wherein the aromatics-containing stream preferably also comprises aromatic hydrocarbons 5 from the outside, and wherein the first reaction unit comprises a mineral-rich precursor material and a hydrogenation catalyst capable of catalyzing at least one reaction selected from hydrodemetallization reaction, hydrodesulfurization reaction, hydrodeasphalting reaction and hydrodecarbonization reaction, and the first reaction unit is a liquid-phase hydrogenation reaction unit; the liquid-phase product from the first reaction unit 7 is fed into a separation unit 19 for fractionation, to provide a second light component 8 and a second heavy component 9, wherein the second light component and the second heavy component have a cutting point of 240-450° C.; the second light component 8 is fed into a second reaction unit 10 for reaction, to provide at least one product selected from a gasoline component 13, a BTX feedstock component 12 and a diesel component 14, wherein the second reaction unit is at least one selected from a hydrocracking unit, a catalytic cracking unit and a diesel hydrogenation upgrading unit; and the second heavy component 9 is fed into a delayed coking unit 11 for reaction, to provide at least one product selected from the group consisting of coker gasoline 15, coker diesel 16, coker wax oil 17 and low sulfur petroleum coke 18; or the second heavy component 9 is used as a low sulfur ship fuel oil component.

Figure 2:
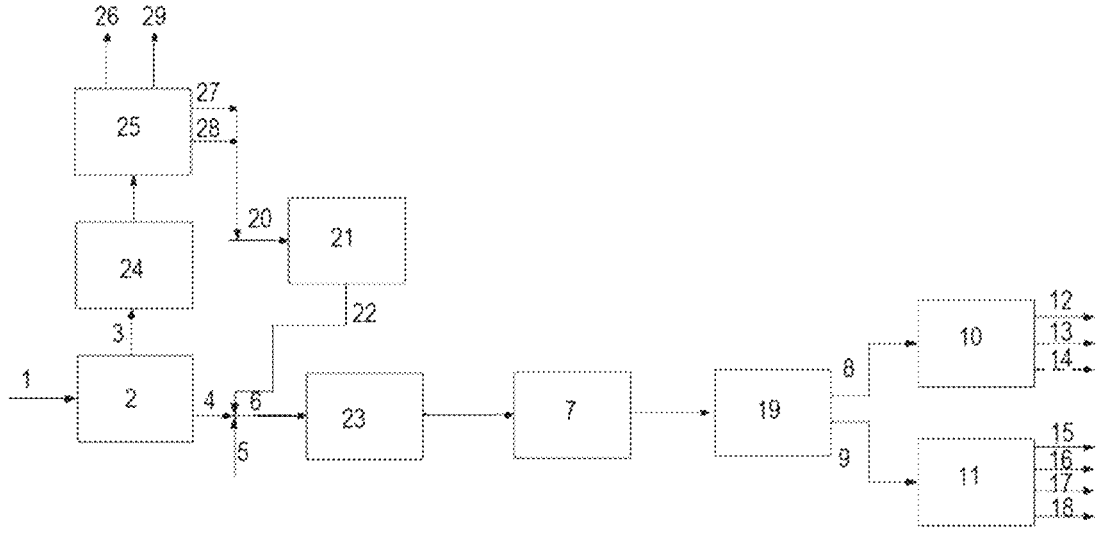
FIG. 2 is a flow chart for processing an aromatics-rich fraction oil in accordance with a first embodiment of the present invention.

As shown in FIG. 2, a heavy oil feedstock 1 is fed into a solvent deasphalting unit 2 for solvent deasphalting treatment to provide a deoiled asphalt 4 and a deasphalted oil 3; the deasphalted oil 3 is fed into a fourth reaction unit 24 for hydrogenation reaction, and a liquid phase effluent obtained in the fourth reaction unit 24 is fed into a DCC unit 25 for reaction, to provide propylene 26, LCO 27, HCO 28 and slurry oil 29; an aromatics-rich fraction oil 20 comprising the LCO 27 and/or the HCO 28 from the DCC unit is fed into a third reaction unit 21 for hydrosaturation, followed by fractionation, to provide a first heavy component 22 and a first light component; a mixed feedstock 6, formed from the deoiled asphalt 4 and the aromatics-containing stream comprising the first heavy component 22, is fed into a first reaction unit 7 for hydrogenation reaction, and the aromatics-containing stream preferably also comprises aromatic hydrocarbons 5 from the outside, wherein the first reaction unit 7 comprises a mineral-rich precursor material and a hydrogenation catalyst capable of catalyzing at least one reaction selected from hydrodemetallization reaction, hydrodesulfurization reaction, hydrodeasphalting reaction and hydrodecarbonization reaction; the liquid phase product from the first reaction unit 7 is fed into a separation unit 19 for fractionation, to provide a second light component 8 and a second heavy component 9; the second light component 8 is fed into a second reaction unit 10 for reaction, to provide at least one product selected from the group consisting of a gasoline component 13, a BTX feedstock component 12, a diesel component 14, or at the second light component 8 is recycled back to the DCC unit 25; and the second heavy component 9 is fed into a delayed coking unit 11 for reaction, to provide at least one product selected from the group consisting of coker gasoline 15, coker diesel 16, coker wax oil 17 and low sulfur petroleum coke 18; or the second heavy component 9 is used as a low sulfur ship fuel oil component.

The technology of the invention enables heavy oil to be efficiently converted and can produce gasoline and BTX raw materials, and a system and a process for flexibly producing low-sulfur ship fuel and low-sulfur petroleum coke.

Compared with the prior art, the invention preferably adopts an effective combination of processes such as residual oil hydrogenation, hydrocracking or catalytic cracking, so that the low-value DOA is converted into the low-sulfur ship fuel component and the low-sulfur petroleum coke raw material which meet the environmental protection requirement, thereby realizing the high-efficiency, environmental-protection and comprehensive utilization of heavy petroleum resources.

In addition, the technology provided by the invention can enable DOA to be efficiently converted in the residual liquid phase hydrogenation reactor and can produce gasoline fraction and BTX raw material, and can provide raw material for producing low-sulfur ship fuel and low-sulfur coke products.

The present invention will be described in detail below by Examples. The following Examples were carried out using the process flow shown in FIG. 1, unless otherwise specified. Without being specifically stated, the following Examples have the following common features:

The results of tables I-3 and II-4 in the following Examples were, unless specifically indicated, the averages of the results obtained from the sampling test every 25 h in a continuous operation of the apparatus for 100 h.

Saturation experiments of the aromatic fraction-rich partial hydrogenation were performed on a medium-scaled fixed bed diesel hydrotreating device, and the total volume of the reactor was 200 mL. In the following Examples, the hydrogenation catalyst and materials used for the partial hydrosaturation of the aromatics-rich fraction oil were RS-2100 series hydrogenation catalysts developed by RIPPs.

The liquid-phase stream obtained by partial hydrogenation saturation was fractioned, to provide a first light component and a first heavy component with a cutting point of 180° C., wherein the first heavy component and DOA formed a mixed feedstock. The mixed feedstocks was subjected to hydrogenation reaction test on a medium-scaled heavy oil liquid-phase hydrotreatment device, and the total volume of the reactor was 200 mL. In the following Examples, the hydrogenation catalyst and the material used in the first reaction unit were RG-30B protective catalyst developed by RIPP, mineral-rich precursor material 1, mineral-rich precursor material 2, RDM-33B residual oil demetallization desulfurization transition catalyst and RCS-31 desulfurization catalyst which were researched and developed by petrochemical engineering science research institute. According to the flowing direction of reactants, a hydrogenation protective catalyst, a mineral-rich precursor material 1, a mineral-rich precursor material 2, a hydrodemetallization and desulfurization catalyst and a hydrodesulfurization catalyst were sequentially loaded. In the first reaction unit, the loading ratio among the catalysts was as follows: RG-30B:mineral-rich precursor material 1:mineral-rich precursor material 2:RDM-33B:RCS-31=6:30:30:14:20 (V/V).

The second reaction unit was a fixed bed hydrocracking device, and the catalysts used were RS-2100 refined catalyst and RHC-131 hydrocracking catalyst developed by RIPP. The fixed bed hydrocracking unit was operated under conditions of: a reaction temperature for the refining section of 370° C., a reaction temperature for the cracking section of 385° C., a reaction pressure of 10 MPa, a liquid hourly volume space velocity of 2.0 $h^{-1}$, and a hydrogen/oil ratio by volume of: 1200:1.

Example A

Preparation of the mineral-rich precursor material 1: 2000 g of RPB110 pseudoboehmite produced by SINOPEC CATALYST CO., LTD. CHANGLING DIVISION was used, in which 1000 g was treated at 550° C. for 2 h to provide about 700 g of alumina, about 700 g of alumina and another 1000 g of pseudoboehmite were fully mixed, then 40 g of sesbania powder and 20 g of citric acid were added, 2200 g of deionized water was added, and the mixture was kneaded and extruded into strips for molding, dried at 300° C. for 3 h to provide about 1730 g of support, into which 2100 mL of a solution containing Mo and Ni was added to for saturation impregnation, wherein the Mo content in the solution was 5.5 wt % calculated as $MoO_3$, the Ni content was 1.5 wt % calculated as NiO, and after impregnation for half an hour, treated at 180° C. for 4 h, to provide the mineral-rich precursor material 1, the properties of which were shown in Table I-6.

Preparation of the mineral-rich precursor material 2: 2000 g of RPB220 pseudoboehmite produced by SINOPEC CATALYST CO., LTD. CHANGLING DIVISION was used, 30 g of sesbania powder and 30 g of citric acid were added, 2400 g of deionized water was added, and the mixture was kneaded and extruded into strips for molding, dried at 120° C. for 5 h to provide about 2040 g of support, into which 2200 mL of a solution containing Mo and Ni was added to for saturation impregnation, wherein the Mo content in the solution was 7.5 wt % calculated as $MoO_3$, the Ni content was 1.7 wt % calculated as NiO, and after impregnation for half an hour, treated at 200° C. for 3 h, to provide the mineral-rich precursor material 2, the properties of which were shown in Table I-6.

Preparation of the mineral-rich precursor material 3: 2000 g of commercially available silica was used, 30 g of sesbania powder and 30 g of sodium hydroxide were added, 2400 g of deionized water was added, and the mixture was kneaded and extruded into strips for molding, dried at 120° C. for 5 h to provide a support, into which 2200 mL of a solution containing Mo and Ni was added to for saturation impregnation, wherein the Mo content in the solution was 4.5 wt % calculated as $MoO_3$, the Ni content was 1.0 wt % calculated as NiO, and after impregnation for half an hour, treated at 200° C. for 3 h, to provide the mineral-rich precursor material 3, the properties of which were shown in Table I-6.

Example I-1

LCO from a RLG plant of Shanghai petrochemical was used as an aromatics-rich fraction oil in this Example, where the LCO hydrogenation was operated under conditions of: a reaction temperature of 290° C., a reaction pressure of 4 MPa, a liquid hourly volume space velocity of 1 $h^{-1}$, and a volume ratio of hydrogen to oil of 800:1.

The properties of LCO and the first heavy component 1 were shown in Table I-1.

DOA from vacuum residue was mixed with the first heavy component 1 at a weight ratio of 1:10, and the properties of the mixed feedstock were shown in Table I-2.

The mixed feedstock of DOA and the first heavy component 1 was first mixed with hydrogen in a hydrogen dissolving unit (with a volume ratio of the feeding amount of hydrogen to the mixed feedstock formed by the deoiled asphalt and the heavy component 1 of 100, an operating temperature of hydrogen dissolving unit of 320° C., and a pressure of 10 MPa), and the mixed material obtained was fed into a first reaction unit. The first reaction unit was operated under conditions of: a reaction temperature of 360° C., a reaction pressure of 10 MPa, a liquid hourly volume space velocity of 0.6 $h^{-1}$, and a volume ratio of the recycling oil to the raw oil at inlet of the first reaction unit of 0.5:1. After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-2

HCO from a catalytic cracking device of Shanghai petrochemical was used as an aromatics-rich fraction oil in this Example, where the HCO hydrogenation was operated under conditions of: a reaction temperature of 330° C., a reaction pressure of 6 MPa, a liquid hourly volume space velocity of 1 $h^{-1}$, and a volume ratio of hydrogen to oil of 800:1.

The properties of HCO and the first heavy component 2 were shown in Table I-1.

DOA from vacuum residue was mixed with the first heavy component 2 at a weight ratio of 5:10, and the properties of the mixed feedstock were shown in Table I-2.

The mixed feedstock of DOA and the hydrogenated HCO, first heavy component 2 was first mixed with hydrogen in a hydrogen dissolving unit (with a volume ratio of the feeding amount of hydrogen to the mixed feedstock formed by the deoiled asphalt and the first heavy component 2 of 100, an operating temperature of hydrogen dissolving unit of 320° C., and a pressure of 10 MPa), and the mixed material obtained was fed into a first reaction unit. The first reaction unit was operated under conditions of: a reaction temperature of 380° C., a reaction pressure of 10 MPa, a liquid hourly volume space velocity of 0.6 $h^{-1}$, and a volume ratio of the recycling oil to the raw oil at inlet of the first reaction unit of 0.5:1. After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-3

LCO same as Example I-1 was used as an aromatics-rich fraction oil in this Example, where the LCO hydrogenation was operated under conditions of: a reaction temperature of 320° C., a reaction pressure of 6 MPa, a liquid hourly volume space velocity of 1 $h^{-1}$, and a volume ratio of hydrogen to oil of 800:1.

The properties of LCO and the first heavy component 3 were shown in Table I-1. The LCO properties and first heavies 3 properties were shown in Table I-1.

DOA was from a vacuum residue and was mixed with the first heavy component 3 at a weight ratio of 10:10, and the properties of the mixed feedstock were shown in Table I-2.

The mixed feedstock of DOA and the first heavy component 3 was first mixed with hydrogen in a hydrogen dissolving unit (with a volume ratio of the feeding amount of hydrogen to the mixed feedstock formed by the deoiled asphalt and the first heavy component 3 of 100, an operating temperature of hydrogen dissolving unit of 320° C., and a pressure of 8 MPa), and the mixed material obtained was fed into a first reaction unit. The first reaction unit was operated under conditions of: a reaction temperature of 370° C., a reaction pressure of 8 MPa, a liquid hourly volume space velocity of 0.6 $h^{-1}$, and a volume ratio of the recycling oil to the raw oil at inlet of the first reaction unit of 0.5:1. After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second heavy component was subjected to a coking reaction at a reaction temperature of 500° C. for 0.5 hour, to provide a petroleum coke (at a yield of 32 wt %) having a sulfur content of 2.7 wt %.

The second light component at a temperature of less than 350° C. was tested in a second reaction unit, to provide a hydrocracking product, the properties of which were shown in Table I-5.

Example I-4

The aromatics-rich fraction oil used in the Example I-4 was coal tar from a coal tar unit in China. The hydrogenation of the coal tar was operated under conditions of: a reaction temperature of 300° C., a reaction pressure of 10 MPa, a liquid hourly volume space velocity of 0.8 $h^{-1}$, and a volume ratio of hydrogen to oil of 800:1.

The properties of the coal tar and the first heavy component 4 were shown in Table I-1.

DOA from vacuum residue was mixed with the first heavy component 4 at a weight ratio of 15:10, and the properties of the mixed feedstock were shown in Table I-2.

The mixed feedstock of DOA and the first heavy component 4 was first mixed with hydrogen in a hydrogen dissolving unit (with a volume ratio of the feeding amount of hydrogen to the mixed feedstock formed by the deoiled asphalt and the first heavy component 4 of 100, an operating temperature of hydrogen dissolving unit of 320° C., and a pressure of 12 MPa), and the mixed material obtained was fed into a first reaction unit. The first reaction unit was operated under conditions of: a reaction temperature of 350° C., a reaction pressure of 12 MPa, a liquid hourly volume space velocity of 0.6 $h^{-1}$, and a volume ratio of the recycling oil to the raw oil at inlet of the first reaction unit of 2:1. After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-5

A process similar to that in Example I-3 was used, except that:

In this Example, the hydrotreatment of the first reaction unit was operated at a temperature of 395° C.

The other conditions were the same as in Example I-3.

After hydrogenation, properties of the mixed feedstock were shown in Table I-3.

The main physicochemical properties of the obtained second heavy component at a temperature of more than 350° C. were shown in Table I-3.

Example I-6

The feedstocks, loading of catalysts and operating conditions of the heavy oil liquid phase hydrotreater for Examples I-6 were same as in Example I-1, except that:

After the mixed feedstock same as in Example I-1 was subjected to liquid-phase heavy oil hydrogenation, every 30 days, the reaction temperature of the reaction was increased by 3° C., and the operation was stopped after 360 days of operation of the hydrogenation test.

The mineral-rich precursor material 1 and the mineral-rich precursor material 2 initially loaded into the reactor became, after reaction, a V-rich material 1 and a V-rich material 2, having a V content of respectively 76 wt % and 71 wt % after roasting analysis, representing a V-content of more than 10 times higher than that of natural ore, which were thus high-quality materials for preparing $V_2O_5$ with high value.

Example I-7

A catalytic cracking test was carried out on the second light component at a temperature of less than 350° C. from Example I-3 in a small scaled catalytic cracking fixed fluidized bed test device, wherein the catalyst was a catalytic cracking catalyst MLC-500 produced by SINOPEC CATALYST CO., LTD. CHANGLING DIVISION.; and the fluidized catalytic unit was operated under conditions of: a reaction temperature of 540° C., a catalyst-to-oil ratio of 6, and a retention time of 2 s.

As a result, a product gasoline was obtained at a yield of 42 wt %, and the gasoline had a RON octane number of 92.

Example I-8

The procedures were similar to those of Example I-1, except that in the present Example, the second heavy component obtained was fed into a delayed coking unit for reaction, to provide a coker gasoline, a coker diesel and a coker wax oil.

The delayed coking unit was operated under conditions of: a reaction temperature of 510° C. and a residence time of 0.6 h.

The coker diesel had a sulfur content of 0.26 wt %, a condensation point of −11° C., and a cetane number of 48.

The coker wax oil had a sulfur content of 1.12 wt %, and a condensation point of 32° C.

The coker gasoline was obtained at a yield of 14.7%, a sulfur content of 0.10 wt %, and a MON of 61.8.

The coker diesel and coker wax oil were recycled to the third reaction unit and mixed with the LCO 1 for hydrotreatment, for which the reaction conditions were same as those of Example I-1.

The properties of the mixed oil of coker diesel, coker wax oil, and LCO and the properties of the first heavy component 8 were shown in Table I-1.

DOA from vacuum residue was mixed with the first heavy component 8 at a weight ratio of 1:10, and the properties of the mixed feedstock were shown in Table I-2.

The mixed feedstock of DOA and the first heavy component 8 was first mixed with hydrogen in a hydrogen dissolving unit (with a volume ratio of the feeding amount of hydrogen to the mixed feedstock formed by the deoiled asphalt and the first heavy component 8 of 100, an operating temperature of hydrogen dissolving unit of 320° C., and a pressure of 8 MPa), and the mixed material obtained was fed into a first reaction unit. The first reaction unit was operated under conditions of: a reaction temperature of 360° C., a reaction pressure of 8 MPa, a liquid hourly volume space velocity of 0.3 $h^{-1}$, and a volume ratio of the recycling oil to the raw oil at inlet of the first reaction unit of 0.5:1. After hydrogenation, properties of the mixed feedstock were shown in Table I-3.

The liquid phase product obtained from the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-9

A test was carried out for the second light component at a temperature of less than 350° C. obtained from Example I-1 on a diesel hydrocracking device, to provide a diesel component.

The operation conditions comprised: a reaction temperature of 360° C., a reaction pressure of 10 MPa, a volume ratio of hydrogen to oil of 1000, and a liquid hourly volume space velocity of 1.0 $h^{-1}$.

As a result, the diesel component had a sulfur content of 5 ppm, a condensation point of −32° C., and a cetane number was of 53.

Example I-10

The procedures were similar to those of Example I-1, except that in the present Example, the loading of the catalysts in the first reaction unit was as follows:

According to the flowing direction of reactants, a hydrogenation protective catalyst, a mineral-rich precursor material 1, a hydrodemetallization and desulfurization catalyst, and a hydrodesulfurization catalyst were sequentially loaded. In the first reaction unit, the loading ratio among the catalysts was as follows: RG-30B:mineral-rich precursor material 1:RDM-33B:RCS-31=6:60:14:20 (V/V).

After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-11

The procedures were similar to those of Example I-1, except that in the present Example, the loading of the catalysts in the first reaction unit was as follows:

According to the flowing direction of reactants, a hydrogenation protective catalyst, a mineral-rich precursor material 2, a mineral-rich precursor material 1, a hydrodemetallization and desulfurization catalyst, and a hydrodesulfurization catalyst were sequentially loaded. In the first reaction unit, the loading ratio among the catalysts was as follows: RG-30B:mineral-rich precursor material 2:mineral-rich precursor material 1:RDM-33B:RCS-31=6:30:30:14:20 (V/V).

After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-12

The procedures were similar to those of Example I-1, except that in the present Example, the loading of the catalysts in the first reaction unit was as follows:

According to the flowing direction of reactants, a hydrogenation protective catalyst, a hydrodemetallization and desulfurization catalyst, and a hydrodesulfurization catalyst were sequentially loaded. In the first reaction unit, the loading ratio among the catalysts was as follows: RG-30B:RDM-33B:RCS-31=15:35:50 (V/V).

After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Example I-13

The procedures were similar to those of Example I-1, except that in the present Example, the loading of the catalysts in the first reaction unit was as follows:

According to the flowing direction of reactants, a hydrogenation protective catalyst, a mineral-rich precursor material 3, a hydrodemetallization and desulfurization catalyst, and a hydrodesulfurization catalyst were sequentially loaded. In the first reaction unit, the loading ratio among the catalysts was as follows: RG-30B:mineral-rich precursor material 3:RDM-33B:RCS-31=10:40:20:30 (V/V).

After hydrogenation, properties of the mixed feedstock were shown in Table I-3.

The liquid phase product obtained by the treatment of the first reaction unit was fractionated, and the properties of a second heavy component at a temperature of more than or equal to 350° C. were shown in Table I-4.

The second light component at a temperature of less than 350° C. was tested in a second reaction unit, to provide a hydrocracking product, the properties of which were shown in Table I-5.

Comparative Example I-1

The catalyst and device were similar to Example I-1, except that:

in the comparative example, the aromatics-rich fraction oil QY (aromatic content 20 wt %) was directly mixed with DOA without passing through a partial hydrosaturation unit. DOA and QY were mixed at a weight ratio of 1:10, and the properties of the mixed feedstock were shown in Table I-2.

Same as in Example I-1, the mixed feedstock of this comparative example was firstly mixed with hydrogen in a hydrogen dissolving unit, and the resulting mixture was fed to a first reaction unit where it was hydrotreated, and properties of the product were shown in Table I-3.

The liquid phase product obtained from hydrotreating by the first reaction unit was fractionated, and the properties of a second heavy component at a temperature of more than or equal to 350° C. were shown in Table I-4.

The second light component at a temperature of less than 350° C. was tested in a fixed bed hydrocracking unit, to provide a hydrocracking product, the properties of which were shown in Table I-5.

Comparative Example I-2

The catalyst and device were similar to Example I-1, except that:

in the comparative example, the aromatics-rich fraction oil QY was directly mixed with DOA without passing through a partial hydrosaturation unit. DOA and QY were mixed at a weight ratio of 2:10, and the properties of the mixed feedstock were shown in Table I-2.

Same as in Example I-1, the mixed feedstock of this comparative example was firstly mixed with hydrogen in a hydrogen dissolving unit, and the resulting mixture was fed to a first reaction unit where it was hydrotreated, and properties of the product were shown in Table I-3.

The liquid phase product obtained from hydrotreating by the first reaction unit was fractionated, and the properties of a second heavy component at a temperature of more than or equal to 350° C. were shown in Table I-4.

The second light component at a temperature of less than 350° C. was tested in a fixed bed hydrocracking unit, to provide a hydrocracking product, the properties of which were shown in Table I-5.

Comparative Example I-3

The catalyst and device were similar to Example I-1, except that:

in the comparative example, the aromatics-rich fraction oil QY was directly mixed with DOA without passing through a partial hydrosaturation unit. DOA and QY were mixed at a weight ratio of 3:10. As the mixed feedstock comprised a large amount of solids (at 100° C.), the next experiment could not be carried out.

TABLE I-1

Properties of aromatics-rich fraction oil before and after hydrogenation

| | Item | Paraffinic alkane wt % | Cycloalkanes wt % | Monocyclic aromatics wt % | Alkyl benzene wt % | Indanes or tetralins wt % | Indenes wt % | Bicyclic and higher aromatics wt % |
|---|---|---|---|---|---|---|---|---|
| Example I-1 | LCO | 14.1 | 6.4 | 24.8 | 11 | 9 | 4.8 | 54.7 |
| | First heavy component 1 | 1.5 | 11.6 | 73.9 | 20 | 48.2 | 5.7 | 13 |

TABLE I-1-continued

Properties of aromatics-rich fraction oil before and after hydrogenation

| | Item | Paraffinic alkane wt % | Cycloalkanes wt % | Monocyclic aromatics wt % | Alkyl benzene wt % | Indanes or tetralins wt % | Indenes wt % | Bicyclic and higher aromatics wt % |
|---|---|---|---|---|---|---|---|---|
| Example I-2 | HCO | 5.6 | 5.3 | 27.3 | 15 | 8 | 4.3 | 61.8 |
| | First heavy component 2 | 2.1 | 9.1 | 76.1 | 22 | 46.2 | 7.9 | 12.7 |
| Example I-3 | LCO | 14.1 | 6.4 | 24.8 | 10 | 9 | 5.8 | 54.7 |
| | First heavy component 3 | 3.6 | 10.5 | 68.5 | 12.6 | 45.9 | 10 | 17.4 |
| Example I-4 | Coal tar | 20.9 | 13.9 | 19.2 | 8.4 | 7.5 | 3.3 | 46 |
| | First heavy component 4 | 10.5 | 17.1 | 67.5 | 15 | 45 | 7.5 | 4.9 |
| Example I-8 | LCO + coker wax oil + coker diesel | 18.3 | 34.4 | 20.6 | 10 | 5 | 5.6 | 26.7 |
| | First heavy component 8 | 9.2 | 26.8 | 51.6 | 13.1 | 38 | 0.5 | 12.4 |

TABLE I-2

Properties of the mixed feedstock

| | Example I-1 | Example I-2 | Example I-3 | Example I-4 | Examples I-8 | Comparative Example I-1 | Comparative Example I-2 |
|---|---|---|---|---|---|---|---|
| Species | DOA: first heavy component 1 | DOA: first heavy component 2 | DOA: first heavy component 3 | DOA: first heavy component 4 | DOA: first heavy component 8 | DOA: QY | DOA: QY |
| Ratio, wt | 1:10 | 5:10 | 10:10 | 15:10 | 1:10 | 1:10 | 2:10 |
| State at 20° C. | Liquid state | Liquid state | Liquid state | Liquid state | Liquid state | Liquid state | Liquid state |
| C7 insoluble substances, wt % | 1.45 | 5.33 | 18.00 | 19.60 | 1.58 | 1.55 | 3.3 |
| Carbon residue, wt % | 1.64 | 6.00 | 18.00 | 20.80 | 1.7 | 1.69 | 2.50 |
| Sulfur, wt % | 0.74 | 2.71 | 4.07 | 4.88 | 0.81 | 0.77 | 1.28 |
| Viscosity (100° C.) ($mm^2/s$) | 3.3 | 10.6 | 45.1 | 46.0 | 3.9 | 3.8 | 4.2 |
| Ni + V (μg/g) | 37.5 | 100.7 | 216.0 | 269.2 | 28.8 | 35.0 | 52.7 |
| Hydrogen content after hydrogen dissolution, wt % | 0.15 | 0.14 | 0.14 | 0.15 | 0.13 | 0.15 | 0.15 |

TABLE I-3

Properties of product after liquid phase hydrotreatment

| Item | C7 insoluble substances, wt % | Carbon residue, wt % | Sulfur, wt % | Viscosity (100° C.), $mm^2/s$ | Ni + V (μg/g) |
|---|---|---|---|---|---|
| Ex. I-1 | 0.4 | 0.8 | 0.14 | 2.1 | 9 |
| Ex. I-2 | 0.5 | 3.2 | 0.46 | 5.6 | 22 |
| Ex. I-3 | 0.5 | 4.5 | 0.47 | 9.8 | 30 |
| Ex. I-4 | 2.7 | 5.1 | 0.56 | 19.1 | 35 |
| Ex. I-5 | 0.5 | 4.2 | 0.42 | 5.8 | 21 |
| Ex. I-8 | 0.5 | 1.0 | 0.16 | 3.2 | 10 |

TABLE I-3-continued

Properties of product after liquid phase hydrotreatment

| Item | C7 insoluble substances, wt % | Carbon residue, wt % | Sulfur, wt % | Viscosity (100° C.), $mm^2/s$ | Ni + V (μg/g) |
|---|---|---|---|---|---|
| Ex. I-10 | 0.4 | 1.2 | 0.12 | 1.8 | 9 |
| Ex. I-11 | 0.6 | 1.5 | 0.12 | 1.8 | 15 |
| Ex. I-12 | 0.4 | 0.9 | 0.13 | 1.8 | 20 |
| Ex. I-13 | 0.3 | 0.8 | 0.14 | 1.9 | 18 |
| C. Ex. I-1 | 1.1 | 1.2 | 0.48 | 2.5 | 16 |
| C. Ex. I-2 | 1.6 | 1.8 | 0.54 | 3.9 | 29 |

TABLE I-4

Properties of second heavy component

| Item | Density (20° C.), $g/cm^3$ | C7 insoluble substances, wt % | Carbon residue, wt % | Sulfur, wt % | Viscosity (100° C.) $mm^2/s$ | (Ni + V) μg/g |
|---|---|---|---|---|---|---|
| Ex. I-1 | 0.9363 | 1.2 | 2.2 | 0.21 | 69.6 | 16 |
| Ex. I-2 | 0.9570 | 1.8 | 5.9 | 0.69 | 80.2 | 35 |
| Ex. I-3 | 0.9938 | 4.2 | 7.9 | 0.71 | 103.6 | 45 |
| Ex. I-4 | 1.0050 | 8.9 | 17.7 | 0.84 | 111.2 | 53 |

TABLE I-4-continued

| Properties of second heavy component | | | | | | |
|---|---|---|---|---|---|---|
| Item | Density (20° C.), g/cm$^3$ | C7 insoluble substances, wt % | Carbon residue, wt % | Sulfur, wt % | Viscosity (100° C.) mm$^2$/s | (Ni + V) μg/g |
| Ex. I-5 | 0.9931 | 3.6 | 6.3 | 0.63 | 90.2 | 37 |
| Ex. I-8 | 0.9362 | 1.2 | 2.5 | 0.24 | 81.9 | 19 |
| Ex. I-10 | 0.9365 | 1.2 | 2.8 | 0.18 | 80.5 | 14 |
| Ex. I-11 | 0.9366 | 1.2 | 2.9 | 0.18 | 81.4 | 23 |
| Ex. I-12 | 0.9365 | 1.2 | 3.0 | 0.20 | 79.3 | 37 |
| Ex. I-13 | 0.9361 | 1.9 | 3.0 | 0.21 | 90.5 | 35 |
| C. Ex. I-1 | 0.9696 | 2.7 | 2.8 | 1.02 | 120.3 | 34 |
| C. Ex. I-2 | 0.9807 | 2.8 | 4.1 | 1.19 | 121.0 | 59 |

TABLE I-5

| Properties of hydrocracking product | | | |
|---|---|---|---|
| Item | Density (20° C.), g/cm$^3$ | RON | Sulfur content, μg/g |
| Ex. I-1 | 0.72 | >92 | <10 |
| Ex. I-2 | 0.72 | >92 | <10 |
| Ex. I-3 | 0.72 | >92 | <10 |
| Ex. I-4 | 0.72 | >92 | <10 |
| Ex. I-8 | 0.72 | >92 | <10 |
| Ex. I-10 | 0.72 | >92 | <10 |
| Ex. I-11 | 0.72 | >92 | <10 |
| Ex. I-12 | 0.72 | >92 | <10 |
| Ex. I-13 | 0.72 | >92 | <10 |
| C. Ex. I-1 | 0.72 | <92 | 11 |
| C. Ex. I-2 | 0.72 | <92 | 11 |

TABLE I-6

| Properties of mineral-rich precursor material | | | | |
|---|---|---|---|---|
| | | Loss on ignition wt % | Specific area, m$^2$/g | Water adsorption, g/g |
| Mineral-rich material 1 | precursor | 13.5 | 263 | 1.08 |
| Mineral-rich material 2 | precursor | 29.9 | 279 | 1.22 |
| Mineral-rich material 3 | precursor | 20.5 | 99 | 1.05 |

Example B

A solvent deasphalting was carried out by using a vacuum residue as feedstock, the solvent was a hydrocarbon mixture comprising butane (a butane content of 70 wt %), wherein the solvent deasphalting was carried out at 120° C., with the solvent:vacuum residue=3:1 (weight ratio), resulting in DAO at a yield of 70 wt %, and DOA at a yield of 30 wt %.

Properties of DAO and DOA obtained were shown in Table II-1.

Example II-1

DAO and DOA used in the Example were from Example II-B.

The properties of the liquid phase product obtained from DAO subjected to hydrogenation reaction in the fourth reaction unit were shown in Table II-1. The liquid product was fed into a DCC unit for reaction, to provide LCO1 and HCO1.

LCO1 was subjected to hydrosaturation in a third reaction unit and then fractionated, to provide a first light component 1 and a first heavy component 1. The hydrogenation of the third reaction unit was operated under conditions of: a reaction temperature of 290° C., a reaction pressure of 4 MPa, a liquid hourly volume space velocity of 1 h$^{-1}$, and a volume ratio of hydrogen to oil of 800:1. Properties of LCO1 and the first heavy component 1 were shown in Table II-2.

DOA and the first heavy component 1 were mixed at a weight ratio of 1:10, and the properties of the mixed feedstock were shown in Table II-3.

DOA and the first heavy component 1 were mixed with hydrogen in a hydrogen dissolving unit, to provide a mixed material (the hydrogen content therein showed in Table II-3). The first reaction unit was operated, for the mixed material, under conditions of: a reaction temperature of 360° C., a reaction pressure of 10 MPa, a liquid hourly volume space velocity of 0.3 h$^{-1}$, and a volume ratio of the recycling oil to the raw oil at inlet of the first reaction unit of 0.5:1. After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-2

DAO and DOA used in the Example were from Example II-B.

The properties of the liquid phase product obtained from DAO subjected to hydrogenation reaction in the fourth reaction unit were shown in Table II-1. The liquid product was fed into a DCC unit for reaction, to provide LCO2 and HCO2.

HCO2 was subjected to hydrosaturation in a third reaction unit and then fractionated, to provide a first light component 2 and a first heavy component 2. The hydrogenation of the third reaction unit was operated under conditions of: a reaction temperature of 330° C., a reaction pressure of 6 MPa, a liquid hourly volume space velocity of 1 h$^{-1}$, and a volume ratio of hydrogen to oil of 800:1. Properties of HCO2 and the first heavy component 2 were shown in Table II-2.

DOA and the first heavy component 2 were mixed at a weight ratio of 5:10, and the properties of the mixed feedstock were shown in Table II-3.

DOA and the first heavy component 2 were mixed with hydrogen in a hydrogen dissolving unit, to provide a mixed material (the hydrogen content therein showed in Table II-3). The first reaction unit was operated, for the mixed material, under conditions of: a reaction temperature of 380° C., a reaction pressure of 8 MPa, a liquid hourly volume space velocity of 0.3 $h^{-1}$, and a volume ratio of the recycling oil to the raw oil at inlet of the first reaction unit of 0.5:1. After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-3

DAO and DOA used in the Example were from Example II-B.

The properties of the liquid phase product obtained from DAO subjected to hydrogenation reaction in the fourth reaction unit were shown in Table II-1. The liquid phase product was fed into a DCC unit (operation conditions same as in Example II-1) for reaction, to provide LCO1 and HCO1.

LCO1 was subjected to hydrosaturation in a third reaction unit and then fractionated, to provide a first light component 3 and a first heavy component 3. The hydrogenation of the third reaction unit was operated under conditions of: a reaction temperature of 320° C., a reaction pressure of 6 MPa, a liquid hourly volume space velocity of 1 $h^{-1}$, and a volume ratio of hydrogen to oil of 800:1. Properties of LCO1 and the first heavy component 3 were shown in Table II-2.

DOA and the first heavy component 3 were mixed at a weight ratio of 10:10, and the properties of the mixed feedstock were shown in Table II-3.

DOA and the first heavy component 3 were mixed with hydrogen in a hydrogen dissolving unit, to provide a mixed material (the hydrogen content therein showed in Table II-3). The first reaction unit was operated, for the mixed material, under conditions of: a reaction temperature of 370° C., a reaction pressure of 8 MPa, a liquid hourly volume space velocity of 0.3 $h^{-1}$, and a volume ratio of the recycling oil to the raw oil at inlet of the first reaction unit of 0.5:1. After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second heavy component was subjected to a coking reaction at a reaction temperature of 500° C. for 0.5 hour, to provide a petroleum coke (at a yield of 31 wt %) having a sulfur content of 2.7 wt %.

The second light fraction at a temperature of less than 350° C. was tested in a second reaction unit, to provide a hydrocracking product, the properties of which were shown in Table II-6.

Example II-4

DAO and DOA used in the Example were from Example II-B.

The properties of the liquid phase product obtained from DAO subjected to hydrogenation reaction in the fourth reaction unit were shown in Table II-1. The liquid phase product was fed into a DCC unit (operation conditions same as in Example II-1) for reaction, to provide LCO1 and HCO1.

The aromatics-rich fraction oil used in the example was coal tar (properties shown in Table II-1) from a coal tar unit in China and LCO1. LCO1 and the coal tar were used at a weight ratio of 1:1. The aromatics-rich fraction oil was subjected to hydrosaturation in a third reaction unit and then fractionated, to provide a first light component 4 and a first heavy component 4. The hydrogenation of the third reaction unit was operated under conditions of: a reaction temperature of 300° C., a reaction pressure of 10 MPa, a liquid hourly volume space velocity of 0.8 $h^{-1}$, and a volume ratio of hydrogen to oil of 800:1. Properties of the aromatics-rich fraction oil and the first heavy component 4 were shown in Table II-2.

DOA and the first heavy component 4 were mixed at a weight ratio of 15:10, and the properties of the mixed feedstock were shown in Table II-3.

DOA and the first heavy component 4 were mixed with hydrogen in a hydrogen dissolving unit, to provide a mixed material (the hydrogen content therein showed in Table II-3). The first reaction unit was operated, for the mixed material, under conditions of: a reaction temperature of 350° C., a reaction pressure of 12 MPa, a liquid hourly volume space velocity of 0.3 $h^{-1}$, and a volume ratio of the recycling oil to the raw oil at inlet of the first reaction unit of 0.5:1. After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-5

A process similar to that in Example II-3 was used, except that:

In this Example, the hydrotreatment of the first reaction unit was operated at a temperature of 395° C.

The other conditions were the same as in Example II-3.

After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

Example II-6

Loading of the catalyst and conditions of the hydrotreatment were same as in Example II-4.

After the mixed feedstock same as in Example II-4 was subjected to hydrotreatment in the first reaction unit, every 30 days, the reaction temperature of the reaction was increased by 3° C., and the operation was stopped after 360 days of operation of the hydrogenation test.

The mineral-rich precursor material 1 and the mineral-rich precursor material 2 initially loaded into the reactor became, after reaction, a V-rich material 1 and a V-rich material 2, having a V content of respectively 69 wt % and 60 wt % after roasting analysis, which were thus high-quality materials for preparing $V_2O_5$ with high value.

Example II-7

A catalytic cracking test was carried out on the second light component at a temperature of less than 350° C. from Example II-3 in a small scaled catalytic cracking fixed fluidized bed test device, wherein the catalyst was a catalytic cracking catalyst MLC-500 produced by SINOPEC CATALYST CO., LTD. CHANGLING DIVISION.; and the fluidized catalytic unit was operated under conditions of: a reaction temperature of 540° C., a catalyst-to-oil ratio of 6, and a retention time of 3 s.

As a result, a product gasoline was obtained at a yield of 40 wt %, and the gasoline had a RON octane number of 93.

Example II-8

The procedures were similar to those of Example except that in the present Example, the second heavy component obtained was fed into a delayed coking unit for reaction, to provide a coker gasoline, a coker diesel and a coker wax oil.

The delayed coking unit was operated under conditions of: a reaction temperature of 510° C. and a residence time of 0.6 h.

The coker diesel had a sulfur content of 0.26 wt %, a condensation point of −11° C., and a cetane number of 48.

The coker wax oil had a sulfur content of 1.12 wt %, and a condensation point of 32° C.

The coker gasoline was obtained at a yield of 14.7%, a sulfur content of 0.10 wt %, and a MON of 61.8.

The coker diesel and coker wax oil were recycled to the third reaction unit and mixed with the LCO 1 for hydrosaturation, and then to fractionated, to provide a first light component 8 and a first heavy component 8 with a cutting point of 180° C., for which the reaction conditions were same as those of Example H-1. The properties of the mixed oil of coker diesel, coker wax oil, and LCO1 and the properties of the first heavy component 8 were shown in Table II-2.

DOA from Example II-B and the first heavy component 8 were mixed at a weight ratio of 1:10, and the properties of the mixed feedstock were shown in Table II-3.

DOA and the first heavy component 8 were mixed with hydrogen in a hydrogen dissolving unit, to provide a mixed material (the hydrogen content therein showed in Table II-3). The first reaction unit was operated under conditions of: a reaction temperature of 360° C., a reaction pressure of 8 MPa, a liquid hourly volume space velocity of 0.3 $h^{-1}$, and a volume ratio of hydrogen to oil of 800:1. After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-9

A test was carried out for the second light component at a temperature of less than 350° C. obtained from Example II-1 on a diesel hydro-upgrading device, to provide a diesel component.

The diesel hydro-upgrading device was operated under conditions of: a reaction temperature of 360° C., a reaction pressure of 12 MPa, a volume ratio of hydrogen to oil of 1000, and a liquid hourly volume space velocity of 1.0 $h^{-1}$.

As a result, the diesel component had a sulfur content of 5 ppm, a condensation point of −33° C., and a cetane number was of 53.

Example II-10

The procedures were similar to those of Example II-1, except that in the present Example, the loading of the catalysts in the first reaction unit was as follows:

According to the flowing direction of reactants, a hydrogenation protective catalyst, a mineral-rich precursor material 1, a hydrodemetallization and desulfurization catalyst, and a hydrodesulfurization catalyst were sequentially loaded. In the first reaction unit, the loading ratio among the catalysts was as follows: RG-30B:mineral-rich precursor material 1:RDM-33B:RCS-31=6:60:14:20 (V/V).

After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-11

The procedures were similar to those of Example II-1, except that in the present Example, the loading of the catalysts in the first reaction unit was as follows:

According to the flowing direction of reactants, a hydrogenation protective catalyst, a mineral-rich precursor material 2, a mineral-rich precursor material 1, a hydrodemetallization and desulfurization catalyst, and a hydrodesulfurization catalyst were sequentially loaded. In the first reaction unit, the loading ratio among the catalysts was as follows: RG-30B:mineral-rich precursor material 2:mineral-rich precursor material 1:RDM-33B:RCS-31=6:30:30:14:20 (V/V).

After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-12

The procedures were similar to those of Example except that in the present Example, the loading of the catalysts in the first reaction unit was as follows:

According to the flowing direction of reactants, a hydrogenation protective catalyst, a hydrodemetallization and desulfurization catalyst, and a hydrodesulfurization catalyst were sequentially loaded. The loading ratio among the catalysts was as follows: RG-30B:RDM-33B:RCS-31=15:40:45 (V/V).

After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Example II-13

The procedures were similar to those of Example II-1, except that in the present Example, the loading of the catalysts in the first reaction unit was as follows:

According to the flowing direction of reactants, a hydrogenation protective catalyst, a mineral-rich precursor material 3, a hydrodemetallization and desulfurization catalyst, and a hydrodesulfurization catalyst were sequentially loaded. The loading ratio among the catalysts was as follows: RG-30B:mineral-rich precursor material 3:RDM-33B:RCS-31=10:40:25:35 (V/V).

After hydrogenation, properties of the mixed feedstock were shown in Table II-4.

The liquid phase product obtained by the treatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Comparative Example II-1

The catalyst and device were similar to Example II-1, except that:

In the comparative example, the aromatics-rich fraction oil QY (aromatic content 20 wt %) was directly mixed with DOA without passing through a partial hydrosaturation unit. DOA and QY were mixed at a weight ratio of 1:10, and the properties of the mixed feedstock were shown in Table II-3.

The mixed material was mixed with hydrogen in a hydrogen dissolving unit, and the mixed material obtained (the hydrogen content therein showed in Table II-3) was hydrotreated by the first reaction unit, for which the properties of product was shown in Table II-4.

The liquid phase product obtained by the hydrotreatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Comparative Example II-2

The catalyst and device were similar to Example II-1, except that:

In the comparative example, the aromatics-rich fraction oil QY was directly mixed with DOA without passing through a partial hydrosaturation unit. DOA and QY were mixed at a weight ratio of 2:10, and the properties of the mixed feedstock were shown in Table II-3.

The mixed material was mixed with hydrogen in a hydrogen dissolving unit, and the mixed material obtained (the hydrogen content therein showed in Table II-3) was hydrotreated by the first reaction unit, for which the properties of product was shown in Table II-4.

The liquid phase product obtained by the hydrotreatment of the first reaction unit was fractionated, and the properties of a second heavy component at a temperature of more than or equal to 350° C. were shown in Table II-5.

The second light fraction at a temperature of less than 350° C. was tested in a second reaction unit, to provide a hydrocracking product, the properties of which were shown in Table II-6.

Comparative Example II-3

The catalyst and device were similar to Example II-1, except that:

In the comparative Example II-3, the aromatics-rich fraction oil QY was directly mixed with DOA without passing through a partial hydrosaturation unit. DOA and QY were mixed at a weight ratio of 3:10. As the mixed feedstock comprised a large amount of solids (at 100° C.), the next experiment could not be carried out.

TABLE II-1

Properties of DOA, DAO, and liquid-phase product after hydrotreatment by the fourth reaction unit

| Item | DOA | DAO | liquid-phase product after hydrotreatment by the fourth reaction unit |
|---|---|---|---|
| Density (20° C.), g/cm$^3$ | 1153.6 | 981.1 | 939.1 |
| Carbon residue, wt % | 53.5 | 10.4 | 5.1 |
| Sulfur content, wt % | 7.2 | 4.5 | 0.39 |
| Nitrogen content, wt % | 0.68 | 0.39 | 0.21 |
| (Ni + V), μg/g | 390 | 39 | 6.8 |

TABLE II-2

Properties of aromatics-rich fraction oil before and after hydrogenation

| | Item | Paraffinic alkane wt % | Cycloalkanes wt % | Monocyclic aromatics wt % | Alkvl benzene wt % | Indanes or tetralins wt % | Indenes wt % | Bicyclic and higher aromatics wt % |
|---|---|---|---|---|---|---|---|---|
| Ex. | LCO1 | 10.9 | 3.5 | 27.8 | 12 | 5 | 10.8 | 57.8 |
| II-1 | First heavy component 1 | 2.7 | 9.8 | 71.4 | 18.5 | 48.6 | 4.3 | 16.1 |
| Ex. | HCO2 | 12.9 | 20 | 13.1 | 5 | 5 | 3.1 | 54 |
| II-2 | First heavy component 2 | 2.1 | 22.5 | 67.9 | 12 | 43.6 | 12.3 | 7.5 |

TABLE II-2-continued

Properties of aromatics-rich fraction oil before and after hydrogenation

| Item | | Paraffinic alkane wt % | Cycloalkanes wt % | Monocyclic aromatics wt % | Alkvl benzene wt % | Indanes or tetralins wt % | Indenes wt % | Bicyclic and higher aromatics wt % |
|---|---|---|---|---|---|---|---|---|
| Ex. II-3 | LCO1 | 10.9 | 3.5 | 27.8 | 12 | 5 | 10.8 | 57.8 |
| | First heavy component 3 | 8 | 8.2 | 69.9 | 12 | 47.9 | 10 | 13.9 |
| Ex. II-4 | LCO1 + coal tar | 17.9 | 13.6 | 15.9 | 5 | 7.1 | 3.8 | 52.6 |
| | First heavy component 4 | 5.9 | 14.9 | 59.8 | 10 | 47 | 2.8 | 19.4 |
| Ex. II-8 | Coker wax oil + coker diesel + LCO1 | 22.7 | 32.4 | 21.3 | 11 | 6.9 | 3.4 | 23.6 |
| | First heavy component 8 | 9.1 | 29.1 | 46.5 | 9.1 | 35.9 | 1.5 | 15.3 |

TABLE III-3

Properties of the mixed feedstock

| | Ex. II-1 | Ex. II-2 | Ex. II-3 | Ex. II-4 | Ex. II-8 | C. Ex. II-1 | C. Ex. II-2 |
|---|---|---|---|---|---|---|---|
| Species | DOA: First heavy component 1 | DOA: First heavy component 2 | DOA: First heavy component 3 | DOA: First heavy component 4 | DOA: first heavy component 8 | DOA: QY | DOA: QY |
| Ratio, wt | 1:10 | 5:10 | 10:10 | 1:10 | 1:10 | 1:10 | 2:10 |
| State at 20° C. | liquid phase | liquid phase | liquid phase | liquid phase | liquid phase | liquid phase | liquid phase |
| C7 insoluble substances/wt % | 3.3 | 12.1 | 19.3 | 25.2 | 3.4 | 3.5 | 4.6 |
| | | | | | 4.7 | 4.9 | 5.9 |
| | | | | | 1.33 | 1.35 | 2.01 |
| Carbon residue, wt % | 4.6 | 8.9 | 20.3 | 26.9 | 2.9 | 2.9 | 3.0 |
| Sulfur, wt % | 1.31 | 2.51 | 3.3 | 4.15 | | | |
| Viscosity (100° C.), ($mm^2/s$) | 2.7 | 3.9 | 40.1 | 45.4 | 36.2 | 35.6 | 50.1 |
| | | | | | 0.15 | 0.14 | 0.15 |
| Ni + V, (μg/g) | 35.2 | 106.7 | 182.2 | 252.6 | | | |
| Hydrogen content after hydrogen dissolution, wt % | 0.15 | 0.15 | 0.14 | 0.15 | | | |

TABLE II-4

Properties of the product after hydrotreatment of the mixed material

| Item | C7 insoluble substances, wt % | Carbon residue, wt % | Sulfur, wt % | Viscosity (100° C.), $mm^2/s$ | Ni + V, (μg/g) |
|---|---|---|---|---|---|
| Ex. II-1 | 0.49 | 2.3 | 0.19 | 1.7 | 8.0 |
| Ex. II-2 | 0.51 | 5.1 | 0.38 | 2.9 | 19.3 |
| Ex. II-3 | 2.49 | 9.39 | 0.54 | 10.1 | 26.4 |
| Ex. II-4 | 3.90 | 11.50 | 0.69 | 12.4 | 39.5 |
| Ex. II-5 | 2.43 | 9.05 | 0.52 | 9.8 | 25.9 |
| Ex. II-8 | 0.51 | 2.4 | 0.21 | 1.9 | 8.5 |

TABLE II-4-continued

Properties of the product after hydrotreatment of the mixed material

| Item | C7 insoluble substances, wt % | Carbon residue, wt % | Sulfur, wt % | Viscosity (100° C.), $mm^2/s$ | Ni + V, (μg/g) |
|---|---|---|---|---|---|
| Ex. II-10 | 0.49 | 2.5 | 0.20 | 1.8 | 8.0 |
| Ex. II-11 | 0.51 | 2.5 | 0.22 | 1.9 | 8.3 |
| Ex. II-12 | 0.55 | 2.9 | 0.29 | 2.2 | 8.9 |
| Ex. II-13 | 0.53 | 2.7 | 0.25 | 2.0 | 8.9 |
| C. Ex. II-1 | 2.18 | 3.4 | 0.56 | 2.3 | 12.7 |
| C. Ex. II-2 | 2.42 | 4.6 | 0.64 | 5.4 | 25.6 |

TABLE II-5

Properties of the second heavy component

| Item | Density (20° C.), $g/cm^3$ | C7 insoluble substances, wt % | Carbon residue, wt % | Sulfur, wt % | Viscosity (100° C.), $mm^2/s$ | (Ni + V), μg/g |
|---|---|---|---|---|---|---|
| Ex. II-1 | 0.9291 | 2.7 | 3.5 | 0.47 | 81.09 | 16 |
| Ex. II-2 | 0.9380 | 3.8 | 7.1 | 0.77 | 93.31 | 25 |
| Ex. II-3 | 0.9729 | 4.2 | 14.1 | 1.51 | 107.22 | 42 |
| Ex. II-4 | 0.9813 | 8.9 | 17.9 | 1.64 | 110.45 | 58 |
| Ex. II-5 | 0.9709 | 4.1 | 13.6 | 1.48 | 105.09 | 39 |
| Ex. II-8 | 0.9297 | 2.7 | 3.6 | 0.48 | 82.01 | 16 |

TABLE II-5-continued

| Properties of the second heavy component | | | | | | |
|---|---|---|---|---|---|---|
| Item | Density (20° C.), g/cm$^3$ | C7 insoluble substances, wt % | Carbon residue, wt % | Sulfur, wt % | Viscosity (100° C.), mm$^2$/s | (Ni + V), μg/g |
| Ex. II-10 | 0.9301 | 2.8 | 3.6 | 0.49 | 83.92 | 17 |
| Ex. II-11 | 0.9303 | 2.9 | 3.6 | 0.49 | 83.98 | 18 |
| Ex. II-12 | 0.9312 | 3.0 | 4.0 | 0.55 | 86.78 | 21 |
| Ex. II-13 | 0.9309 | 2.9 | 3.8 | 0.51 | 85.79 | 19 |
| C. Ex. II-1 | 0.9355 | 5.7 | 6.2 | 0.99 | 87.59 | 25 |
| C. Ex. II-2 | 0.9518 | 7.9 | 8.1 | 1.11 | 100.72 | 53 |

TABLE II-6

| Properties of the hydrocracking product | | | |
|---|---|---|---|
| Item | Density (20° C.), g/cm$^3$ | RON | Sulfur content, μg/g |
| Ex. II-1 | 0.72 | >92 | <10 |
| Ex. II-2 | 0.72 | >92 | <10 |
| Ex. II-3 | 0.72 | >92 | <10 |
| Ex. II-4 | 0.72 | >92 | <10 |
| Ex. II-8 | 0.72 | >92 | <10 |
| Ex. II-10 | 0.72 | >92 | <10 |
| Ex. II-11 | 0.72 | >92 | <10 |
| Ex. II-12 | 0.72 | >92 | <10 |
| Ex. II-13 | 0.72 | >92 | <10 |
| C. Ex. II-1 | >0.72 | <92 | 13 |
| C. Ex. II-2 | >0.72 | <92 | 12 |

TABLE II-7

| Properties of mineral-rich precursor material | | | | |
|---|---|---|---|---|
| | | Loss on ignition wt % | Specific surface area, m$^2$/g | Water absorption, g/g |
| Mineral-rich material 1 | precursor | 13.5 | 263 | 1.08 |
| Mineral-rich material 2 | precursor | 29.9 | 279 | 1.22 |
| Mineral-rich material 3 | precursor | 20.5 | 99 | 1.05 |

From the results above, it can be seen that the technology of the present invention enables high quality raw materials for the production of low sulfur ship fuel or low sulfur coke products from DOA.

Moreover, the technology of the invention can provide gasoline products with high quality meeting national V standards.

The preferred embodiments of the present invention have been described above in detail, but the present invention is not limited thereto. Within the scope of the technical idea of the invention, many simple modifications can be made to the technical solution of the invention, including various technical features being combined in any other suitable ways, and these simple modifications and combinations should also be regarded as the disclosure of the invention, and all fall within the scope of the invention.

What is claimed is:

1. A process for processing an aromatics-rich fraction oil, comprising:

(11) introducing a heavy raw oil into a solvent deasphalting unit for solvent deasphalting treatment, to provide a deoiled asphalt and a deasphalted oil;

(12) introducing the deasphalted oil into a fourth reaction unit for hydrogenation reaction, introducing a liquid phase effluent obtained in the fourth reaction unit into a DCC unit for reaction, to provide propylene, LCO, HCO and slurry oil;

(1) introducing an aromatics-rich fraction oil comprising the LCO and/or HCO from the DCC unit into a third reaction unit for hydrosaturation, followed by fractionation, to provide a first light component and a first heavy component, wherein the first light component and the first heavy component has a cutting point of 100-250° C., and the aromatic content in the first heavy component is more than or equal to 20 wt %;

(2) introducing the deoiled asphalt and an aromatics-comprising stream comprising the first heavy component from step (1) into a hydrogen dissolving unit to be mixed with hydrogen to form a mixed material, and introducing the mixed material into a first reaction unit for a hydrogenation reaction, wherein the deoiled asphalt and the aromatics-containing stream are used in such an amount ratio that a mixed feedstock formed by the deoiled asphalt and the aromatics-containing stream is in liquid state at a temperature of not higher than 400° C.;

(3) fractionating a liquid-phase product from the first reaction unit to provide a second light component and a second heavy component, wherein the cutting point for the second light component and the second heavy component is at 240-450° C.;

(41) introducing the second light component into a second reaction unit for reaction, to provide at least one product selected from a gasoline component, a diesel component and a BTX feedstock component, wherein the second reaction unit is at least one selected from the group consisting of a hydrocracking unit, a catalytic cracking unit and a diesel hydro-upgrading unit; and

(42) introducing the second heavy component into a delayed coking unit for reaction, to provide at least one product selected from the group consisting of coker gasoline, coker diesel, coker wax oil and low sulfur petroleum coke; or using the second heavy component as a component of low sulfur ship fuel oil.

2. The process according to claim 1, wherein in step (2), the deoiled asphalt and the aromatics-containing stream are used in a ratio such that the viscosity at 100° C. of the mixed feedstock formed from the deoiled asphalt and the aromatics-containing stream is not greater than 400 mm$^2$/s, and/or wherein in step (2), the first reaction unit comprises a mineral-rich precursor material and a hydrogenation catalyst, the first reaction unit is a liquid-phase hydrogenation reaction unit, the mineral-rich precursor material is a material capable of adsorbing at least one metal selected from V, Ni, Fe, Ca and Mg.

3. The process according to claim 1, wherein in step (2), the mineral-rich precursor material has a loss on ignition of not less than 3 wt %, a specific surface area of not less than 80 $m^2/g$, and a water absorption of not less than 0.9 g/g.

4. The process according to claim 3, wherein in step (2), the mineral-rich precursor material comprises a support and an active component element loaded on the support, wherein the support is at least one selected from the group consisting of aluminum hydroxide, alumina and silica, and the active component element is at least one metal element selected from the group consisting of Group VIB and Group VIII.

5. The process according to claim 4, wherein in step (2), according to the flowing direction of reactants, the first reaction unit is sequentially loaded with a first mineral-rich precursor material and a second mineral-rich precursor material, and the second mineral-rich precursor material has a loss on ignition equal to or greater than that of the first mineral-rich precursor material;

wherein the first mineral-rich precursor material has a loss on ignition of 3-15% by weight, and the second mineral-rich precursor material has a loss on ignition of not less than 15% by weight; and/or the first mineral-rich precursor material and the second mineral-rich precursor material are loaded at a ratio by volume of from 5:95 to 95:5.

6. The process according to claim 1, wherein in step (2), the aromatics-containing stream further comprises an aromatic hydrocarbon and/or an aromatic oil, wherein the aromatic oil is at least one selected from the group consisting of LCO, HCO, FGO, ethylene tar, coal tar, coker diesel, and coker wax oil; and/or the aromatic hydrocarbon is at least one selected from the group consisting of benzene, toluene, xylene, naphthalene, naphthalene substituted with at least one $C_{1-6}$ alkyl group, and tricyclic or higher aromatic hydrocarbons.

7. The process according to claim 1, wherein the aromatics-rich fraction oil has an aromatic content of more than or equal to 20 wt %.

8. The process according to claim 1, wherein in the solvent deasphalting unit, the yield of the deoiled asphalt is not more than 50% by weight.

9. The process according to claim 1, wherein in step (2), the weight ratio of the amount of the deoiled asphalt to the amount of the aromatics-containing stream is from 1:10 to 50:10.

10. The process according to claim 1, further comprising: recycling the coker diesel and/or coker wax oil obtained in step (42) to the third reaction unit in step (1) for hydrosaturation.

11. The process according to claim 10, wherein in step (2), the first reaction unit is operated under conditions of: a reaction temperature of 260-500° C., a reaction pressure of 2.0-20.0 MPa, and a liquid hourly space velocity of 0.1-1.5 $h^{-1}$.

12. The process according to claim 1, wherein in step (1), the third reaction unit is at least one of a fixed bed reactor, a moving bed reactor and a boiling bed reactor; and/or wherein the third reaction unit is operated under conditions of: a reaction temperature of 200-420° C., a reaction pressure of 2-18 MPa, a liquid hourly space velocity of 0.3-10 $h^{-1}$, and a volume ratio of hydrogen to oil of 50-5000.

13. The process according to claim 1, wherein in step (41), the second reaction unit is a hydrocracking unit, operated under conditions of: a reaction temperature of 360-420° C., a reaction pressure of 10.0-18.0 MPa, a volume ratio of hydrogen to oil of 600-2000, and a liquid hourly volume space velocity of 1.0-3.0 $h^{-1}$; and/or wherein the hydrocracking unit is loaded with at least one hydrotreating catalyst and at least one hydrocracking catalyst.

14. The process according to claim 1, wherein in step (41), the second reaction unit is a catalytic cracking unit, and the catalytic cracking unit is a fluid catalytic cracking unit;

wherein the fluid catalytic cracking unit is operated under conditions of: a reaction temperature of 500-600° C., a catalyst-to-oil ratio of 3-12, and a retention time of 0.6-6 s.

15. The process according to claim 1, wherein in step (41), the second reaction unit is a diesel hydrogenation upgrading unit, wherein the diesel hydrogenation upgrading unit is operated under conditions of: a reaction temperature of 330-420° C., a reaction pressure of 5.0-18.0 MPa, a volume ratio of hydrogen to oil of 500-2000, and a liquid hourly volume space velocity of 0.3-3.0 $h^{-1}$; and/or the diesel hydrogenation upgrading unit is loaded with at least one diesel hydrogenation upgrading catalyst.

16. The process according to claim 1, wherein in step (42), the second heavy component is introduced into the delayed coking unit for reaction, to provide at least one product selected from coker gasoline, coker diesel, coker wax oil and low sulfur petroleum coke, wherein the delayed coking unit is operated under conditions of: a reaction temperature of 440-520° C., and a retention time of 0.1-4 h; and/or in step (42), the sulfur content of the second heavy component is not greater than 1.8 wt %, the second heavy component is introduced into the delayed coking unit for reaction, to provide the low-sulfur petroleum coke.

17. The process according to claim 1, wherein in step (42), the second heavy component is used as a low-sulfur ship fuel oil component, and the conditions are controlled such that the sulfur content of the low-sulfur ship fuel oil component is not more than 0.5 wt %.

18. The process according to claim 1, wherein the fourth reaction unit is a fixed bed reaction unit.

19. The process according to claim 18, further comprising: recycling the coker diesel and/or coker wax oil obtained in step (42) to the third reaction unit for hydrosaturation.

20. The process according to claim 18, wherein in step (12), the fourth reaction unit is operated under conditions of: a reaction temperature of 280-400° C., a reaction pressure of 6.0-14.0 MPa, a volume ratio of hydrogen to oil of 600-1200, and a liquid hourly space velocity of 0.3-2.0 $h^{-1}$; and/or in step (12), the fourth reaction unit is loaded with at least two hydrogenation catalysts;

in step (12), at least one of the hydrogenation catalysts is a catalyst capable of catalyzing at least one reaction selected from the group consisting of a hydrodemetallization reaction, a hydrodesulfurization reaction, and a hydrodecarbonization reaction; and in step (12), at least one of the hydrogenation catalysts comprises alumina as the support and a metal element from Group VIB and/or Group VIII as an active component element, and optionally at least one auxiliary element selected from P, Si, F and B.

* * * * *